US007911383B2

(12) United States Patent
Haskell

(10) Patent No.: US 7,911,383 B2
(45) Date of Patent: Mar. 22, 2011

(54) PHASED ARRAY ANTENNA SYSTEM WITH TWO DIMENSIONAL SCANNING

(75) Inventor: Philip Edward Haskell, Worcestershire (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 12/300,672

(22) PCT Filed: May 29, 2007

(86) PCT No.: PCT/GB2007/002000

§ 371 (c)(1),
(2), (4) Date: Nov. 13, 2008

(87) PCT Pub. No.: WO2007/141484

PCT Pub. Date: Dec. 13, 2007

(65) Prior Publication Data

US 2009/0167605 A1 Jul. 2, 2009

(30) Foreign Application Priority Data

Jun. 9, 2006 (GB) ..... 0611379.9
Mar. 9, 2007 (GB) ..... 0704529.7

(51) Int. Cl.
*H01Q 3/34* (2006.01)

(52) U.S. Cl. ..... 342/372; 342/373; 342/377

(58) Field of Classification Search ..... 342/81, 342/368–377, 860–865, 700 MS; 343/860–865, 343/700 MS See application file for complete search history.

(56) References Cited

U.S. PATENT DOCUMENTS

| | | | | |
|---|---|---|---|---|
| 3,277,481 | A | 10/1966 | Robin et al. | |
| 4,028,710 | A * | 6/1977 | Evans | 342/374 |
| 4,257,050 | A * | 3/1981 | Ploussios | 342/372 |
| 5,281,974 | A | 1/1994 | Kuramoto et al. | |
| 5,502,447 | A | 3/1996 | Kumpfbeck et al. | |
| 6,025,803 | A | 2/2000 | Bergen et al. | |
| 6,538,603 | B1 | 3/2003 | Chen et al. | |
| 7,081,851 | B1 * | 7/2006 | Lewis | 342/372 |

FOREIGN PATENT DOCUMENTS

| | | |
|---|---|---|
| EP | 0313057 | 4/1989 |
| JP | 04-320122 | 11/1992 |
| WO | WO03/036756 | 5/2003 |
| WO | WO03/43127 | 5/2003 |
| WO | WO2004/036785 | 4/2004 |
| WO | WO2004/088790 | 10/2004 |
| WO | WO2004/102739 | 11/2004 |
| WO | WO 2005/048401 | 5/2005 |

* cited by examiner

*Primary Examiner* — Thomas H Tarcza
*Assistant Examiner* — Cassi Galt
(74) *Attorney, Agent, or Firm* — McDonnell Boehnen Hulbert & Berghoff LLP

(57) ABSTRACT

A phased array antenna system with two dimensional scanning includes a two dimensional array A of antenna elements $A_{1,1}$ to $A_{12,12}$ arranged in lines; each line is associated with a respective first rank corporate feed network $\mathbf{16}_1$ to $\mathbf{16}_{12}$ having outputs $\mathbf{17}_{1,1}$ to $\mathbf{17}_{12,12}$ connected to respective antenna elements $A_{1,1}$ to $A_{12,12}$ and inputs for variable relative phase input signals. These corporate feed networks each have first and second inputs A1/B1 to A12/B12 connected respectively to outputs $\mathbf{17}_{1\ CD}/\mathbf{17}_{12CD}$ to $\mathbf{17}_{1EF}/\mathbf{17}_{12EF}$ of different second rank corporate feed networks $\mathbf{16}_{CD}$ and $\mathbf{16}_{EF}$. The corporate feed networks $\mathbf{16}_1$ to $\mathbf{16}_{EF}$ convert input signals of variable relative phase into relatively greater numbers of output signals for a phased array. The system (30) includes a phase varying circuit 40 for varying phase differences between input signals to each second rank corporate feed network $\mathbf{16}_{CD}$ or $\mathbf{16}_{EF}$ and between input signals to different second rank corporate feed networks $\mathbf{16}_{CD}$ and $\mathbf{16}_{EF}$ to provide control of antenna beam direction in two dimensions.

16 Claims, 8 Drawing Sheets

PHASED ARRAY ANTENNA SYSTEM WITH TWO DIMENSIONAL SCANNING

BACKGROUND OF THE INVENTION (1) Field of the Invention

The present invention relates to a phased array antenna system with two dimensional scanning. It is suitable for use in all areas of technology employing scanning phased array antennas, e.g. radar, television and radio broadcasting and telecommunications, mobile cellular radio ("mobile telephones") in particular.

(2) Description of the Art

Phased array antennas are well known: the subject is discussed in detail in for example a standard textbook well known in the art of antennas, "Microwave Scanning Antennas", R. C. Hansen, Vol 3 Array Systems, Academic Press, NY, 1966. Such an antenna comprises an array of individual antenna elements (usually eight or more) such as dipoles or patches. The antenna has a radiation pattern incorporating a main lobe or beam and side lobes. The centre of the main lobe is the antenna's direction of maximum sensitivity in receive mode and the direction of its main output radiation beam in transmit mode.

It is a well known property of a phased array antenna that delaying signals received by antenna elements by a delay which varies with element distance across the array, then the antenna main radiation beam is steered or tilted towards the direction of increasing delay. The angle between main radiation beam centres corresponding to zero and non-zero variation in delay, i.e. the angle of tilt, depends on the rate of change of delay with distance across the array. Delay may be implemented equivalently by changing signal phase (hence the expression phased array, albeit a specific value of delay corresponds to different phase shifts at different frequencies). The main beam direction of the antenna pattern can therefore be altered (referred to as "beam steering") by adjusting the phase relationship between signals fed to antenna elements.

A conventional technique for beam steering by adjusting the phase relationship between signals fed to antenna elements is to provide a respective variable phase, shifter or variable delay for each antenna element. This provides control of each antenna element's signal independently of other antenna elements' signals. Equivalently, cascaded arrangements of variable phase shifters may be used in which each variable phase shifter provides a signal to a respective antenna element and to a respective variable phase shifter. Examples of the use of multiple variable phase shifters are disclosed by, for example, Japanese published Patent Application No. 04-320122 and U.S. Pat. Nos. 3,277,481, 4,242,352 and 5,281,974.

The use of variable phase shifters in numbers comparable with antenna elements is undesirable, because it greatly increases antenna design complexity and expense. A variable phase shifter is much more complex than a fixed phase shifter. This problem is particularly relevant to the case of a two dimensional phased array antenna which is required to scan in both dimensions: e.g. a phased array antenna consisting of a 64×64 array of antenna elements would require 4095 variable phase shifters and respective associated control circuitry.

The problem of excessive numbers of variable phase shifters has been addressed for the case of a one dimensional phased array antenna (e.g. a line of dipoles) scanned in a plane of the array dimension: the following published International Patent Applications disclose solutions to the one dimensional problem, WO 03/036756, WO 03/43127, WO 2004/036785, WO 2004/088790, WO 2004/102739 and WO 2005/048401.

However, these do not scale up straightforwardly to two dimensions: for a two dimensional array of antenna elements arranged in rows and columns, using one of these prior art solutions per row or column permits scanning of all rows or columns in one dimension, but not scanning in another (orthogonal) dimension. The issue of scanning phased arrays is discussed in a standard work in the art of antennas, "Antenna Engineering Handbook", Ed. Richard C. Johnson, McGraw Hill, 3rd Edition, 1993, ISBN 0-07-032381-X: see page 20-52 in particular.

SUMMARY OF THE INVENTION

It is an object of the invention to provide a phased array antenna system suitable for two dimensional scanning.

The present invention provides a phased array antenna system having a two dimensional array of antenna elements and a plurality of corporate feed networks, and wherein:

a) the corporate feed networks are grouped in first and second ranks and are arranged to convert network input signals of variable phase relative to one another into network output signals phased appropriately for antenna elements of a phased array, the network output signals being in relatively greater numbers than the network input signals for corporate feed networks in at least one of the first and second ranks;
b) first rank corporate feed networks are arranged to provide network output signals as input signals to respective lines of antenna elements; and
c) second rank corporate feed networks are arranged to provide network output signals as input signals to respective lines of inputs of first rank corporate feed networks; and
d) the system includes phase difference control means for varying network input signal phasing for second rank corporate feed networks to provide control of antenna beam direction in two dimensions.

The invention makes possible control of antenna beam direction in two dimensions: it provides antenna array input using two ranks of corporate feed networks arranged in cascade with network input phase difference control. This provides a solution to the problem of obtaining two dimensional control of phased array antenna beam direction.

The phase difference control means may be arranged to:

a) vary the phase difference between each input signal to one second rank corporate feed network and input signals to another second rank corporate feed network to provide control of antenna beam direction in a first dimension; and
b) vary both the phase difference between input signals to one second rank corporate feed network and the phase difference between input signals to another second rank corporate feed network to provide control of antenna beam direction in a second dimension.

The phase difference control means may be arranged to maintain:

a) the phase difference between input signals to one second rank corporate feed network to be equal to the phase difference between input signals to another second rank corporate feed network; and
b) the phase differences between each input signal to one second rank corporate feed network and both input signals to another second rank corporate feed network to be equal.

In one embodiment of a system of the invention having corporate feed networks each with two inputs, the phase difference control means arranged in this way avoids cross-coupling between control of scanning in different dimensions. Here cross-coupling means that an angle of deflection of an antenna beam in one dimension is altered when an angle of deflection in another dimension is changed by scan control.

In another aspect, the present invention provides a phased array antenna system including a two dimensional array of antenna elements arranged in lines, and wherein:

a) each line of antenna elements is associated with a respective first rank corporate feed network having outputs for providing signals to respective antenna elements and inputs for receiving signals of variable phase relative to one another;

b) the first rank corporate feed networks have:
   i) first inputs connected to outputs of one second rank corporate feed network;
   ii) second inputs connected to outputs of another second rank corporate feed network;

c) the corporate feed networks provide a means for converting input signals of variable phase relative to one another into multiple output signals for phased array antenna elements, the number of output signals being relatively greater than the number of input signals; and d) the system includes phase difference varying means for:
   i) varying the phase difference between each input signal to one second rank corporate feed network and input signals to another second rank corporate feed network to provide control of antenna beam direction in a first dimension; and
   ii) varying both the phase difference between input signals to one second rank corporate feed network and the phase difference between input signals to another second rank corporate feed network to provide control of antenna beam direction in a second dimension.

Each corporate feed network may provide a means for converting input signals expressed by vectors A and B into other signal vectors given by expressions of the form $p_iA+q_iB$, where $p_i$ and $q_i$ are numerical factors (real or complex) in the range −1 to 1.

The phase difference varying means may comprise:

a) a first variable phase shifter connected via a splitter to a second variable phase shifter and a first fixed phase shifter each connected to respective inputs of one second rank corporate feed network;

b) a second fixed phase shifter connected via a splitter to a third variable phase shifter and a third fixed phase shifter each connected to respective inputs of another second rank corporate feed network; and c) means for ganging together operation of the second and third variable phase shifters.

Antenna elements may be positioned to define a curved surface such as a cylindrical, spherical or toroidal surface.

In an alternative aspect, the present invention provides a method of scanning a phased array antenna system having a two dimensional array of antenna elements and a plurality of corporate feed networks, and wherein:

a) the corporate feed networks are grouped in first and second ranks and are arranged to convert network input signals of variable phase relative to one another into network output signals phased appropriately for antenna elements of a phased array, the network output signals being in relatively greater numbers than the network input signals for corporate feed networks in at least one of the first and second ranks;

b) first rank corporate feed networks are arranged to provide network output signals as input signals to respective lines of antenna elements; and c) second rank corporate feed networks are arranged to provide network output signals as input signals to respective lines of inputs of first rank corporate feed networks; and d) the method includes varying network input signal phasing for second rank corporate feed networks to provide control of antenna beam direction in two dimensions.

The step of varying network input signal phasing may comprise:

a) varying the phase difference between each input signal to one second rank corporate feed network and input signals to another second rank corporate feed network to provide control of antenna beam direction in a first dimension; and b) varying both the phase difference between input signals to one second rank corporate feed network and the phase difference between input signals to another second rank corporate feed network to provide control of antenna beam direction in a second dimension.

The step of varying network input signal phasing may include maintaining equal:

a) the phase difference between input signals to one second rank corporate feed network and the phase difference between input signals to another second rank corporate feed network; and b) the phase differences between each input signal to one second rank corporate feed network and both input signals to another second rank corporate feed network.

In a further alternative aspect, the present invention provides a method of scanning a phased array antenna system having a two dimensional array of antenna elements arranged in lines, and wherein:

a) each line of antenna elements is associated with a respective first rank corporate feed network having outputs for providing signals to respective antenna elements and inputs for receiving signals of variable phase relative to one another;

b) the first rank corporate feed networks have:
   i) first inputs connected to outputs of one second rank corporate feed network;
   ii) second inputs connected to outputs of another second rank corporate feed network;

c) the corporate feed networks provide a means for converting input signals of variable phase relative to one another into multiple output signals for phased array antenna elements the output signals being in relatively greater in number compared to the input signals; and the method includes:
   i) varying the phase difference between each input signal to one second rank corporate feed network and input signals to another second rank corporate feed network to provide control of antenna beam direction in a first dimension; and
   ii) varying both the phase difference between input signals to one second rank corporate feed network and the phase difference between input signals to another second rank corporate feed network to provide control of antenna beam direction in a second dimension.

Each corporate feed network may provide a means for converting input signals expressed by vectors A and B into other signal vectors given by expressions of the form $p_iA+q_iB$, where $p_i$ and $q_i$ are numerical factors (real or complex) in the range −1 to 1.

The steps of varying phase difference may comprise:

a) applying a first variable phase shift via a splitter to a second variable phase shifter and a first fixed phase shifter each connected to respective inputs of one second rank corporate feed network;

b) applying a second fixed phase shift via a splitter to a third variable phase shifter and a third fixed phase shifter each connected to respective inputs of another second rank corporate feed network; and c) ganging together operation of the second and third variable phase shifters.

The method may include positioning the antenna elements to define a curved surface such as a cylindrical, spherical or toroidal surface.

DESCRIPTION OF THE FIGURES

In order that the invention might be more fully understood, embodiments thereof will now be described, by way of example only, with reference to the accompanying drawings, in which:—

DESCRIPTION OF THE INVENTION

Figure 1:
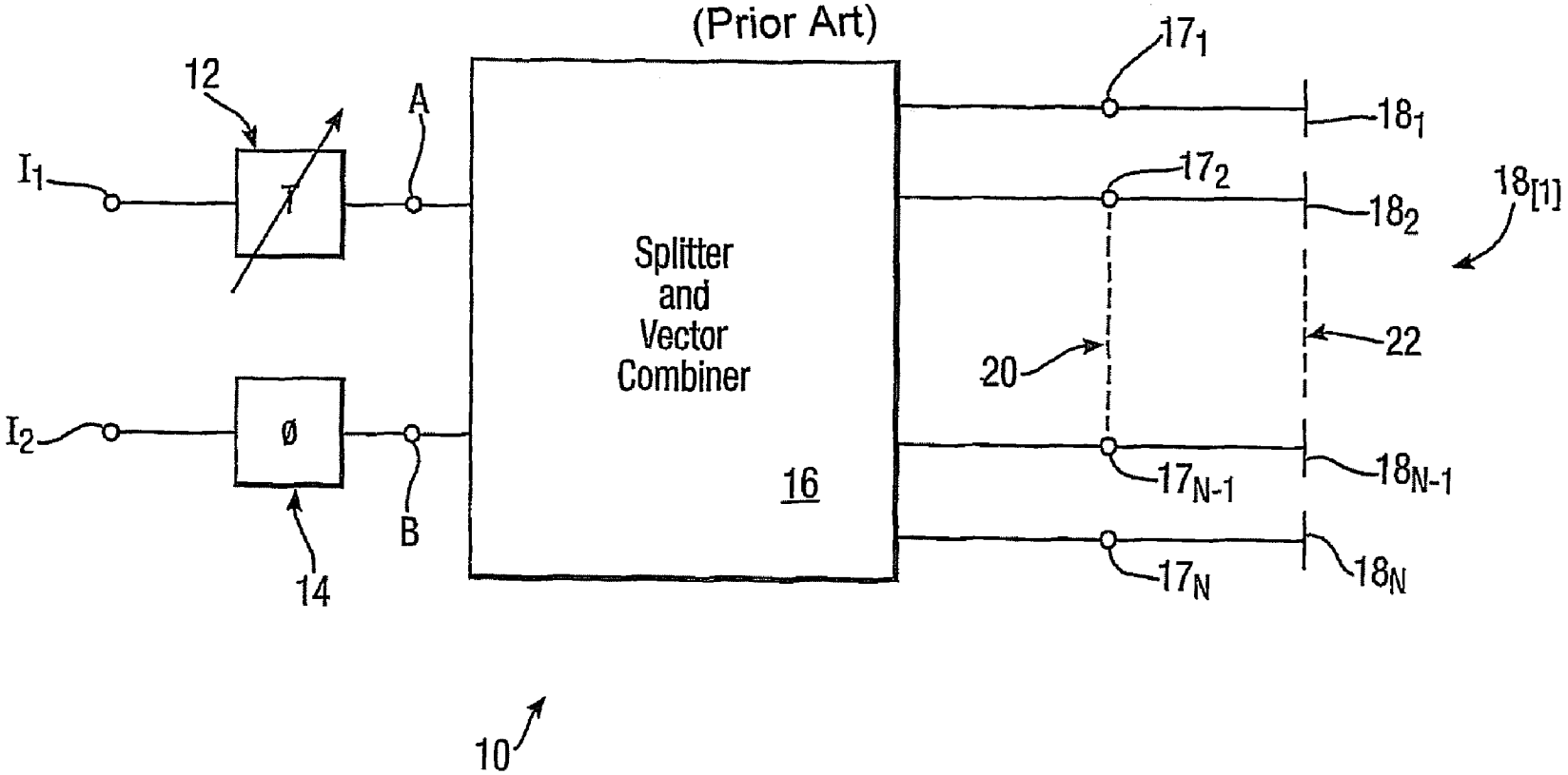
Fig. 1. (Prior Art)
FIG. 1 is a block diagram of a prior art antenna system suitable for one dimensional beam scanning.

Referring to FIG. 1, a prior art phased array antenna scanning circuit is illustrated schematically and indicated generally by 10. The circuit 10 is a generalised version of an equivalent disclosed in WO 2004/102739: it has two inputs $I_1$ and $I_2$ connected respectively to a variable delay or variable phase shifter 12 and a fixed delay or phase shifter 14, which are in turn both connected respectively to inputs A and B of a splitter and vector combiner unit 16 having output terminals $\mathbf{17}_1$ to $\mathbf{17}_N$. The splitter and vector combiner unit 16 is referred to in the art of phased array antennas as a corporate feed network for an antenna array. The circuit 10 has a one dimensional antenna array 18[1] consisting of a line of antenna elements $\mathbf{18}_1$ to $\mathbf{18}_N$, which are connected to the output terminals $\mathbf{17}_1$ to $\mathbf{17}_N$ respectively: here N represents any number of output terminals $\mathbf{17}_1$ etc. and antenna elements $\mathbf{18}_1$ etc., and dotted lines 20 and 22 indicate that these outputs and antenna elements may be replicated as required.

In operation of the circuit 10, radio frequency (RF) input signals are fed to the inputs A and B: these signals may be obtained by splitting a single RF signal. The input signals pass to the variable and fixed phase shifters 12 and 14 respectively. The variable phase shifter 12 applies an operator-selectable phase shift or time delay, and the degree of phase shift applied here controls the angle of electrical tilt of the array 18[1] of antenna elements $\mathbf{18}_1$ to $\mathbf{18}_N$. The fixed phase shifter 48 is not essential but convenient: it applies a fixed phase shift of half the maximum phase shift $\Phi_M$ applicable by the variable phase shifter 46. This allows one input signal to be variable in phase in the range $-\Phi_M/2$ to $+\Phi_M/2$ relative to the other.

Relatively phase shifted signals pass from the variable and fixed phase shifters 12 and 14 to the splitter and vector combiner unit 16: this unit splits the relatively phase shifted signals into component signals from which it forms various vectorial combinations to provide a respective drive signal for each individual antenna element $\mathbf{18}_1$ to $\mathbf{18}_N$. The drive signals have appropriate phasing relative to one another to provide for the antenna beam to be steerable in one dimension in response to alteration of the phase shift introduced by the variable phase shifter 12. If the array 18[1] of antenna elements $\mathbf{18}_1$ to $\mathbf{18}_N$ lies in a vertical plane, the antenna beam is steerable in that plane.

The circuit 10 may be thought of as a "few to many" signal converter or corporate feed network, since it provides for relatively few (e.g. two) signals with variable relative phase shift from inputs A and B to be converted to relatively many (e.g. twelve) antenna element drive signals with multiple variable relative shift shifts, i.e. a respective variable relative phase shift between drive signals to each adjacent pair of antenna elements $\mathbf{18}_i$ to $\mathbf{18}_{i+1}$ (i=1 to N−1).

Figure 2:
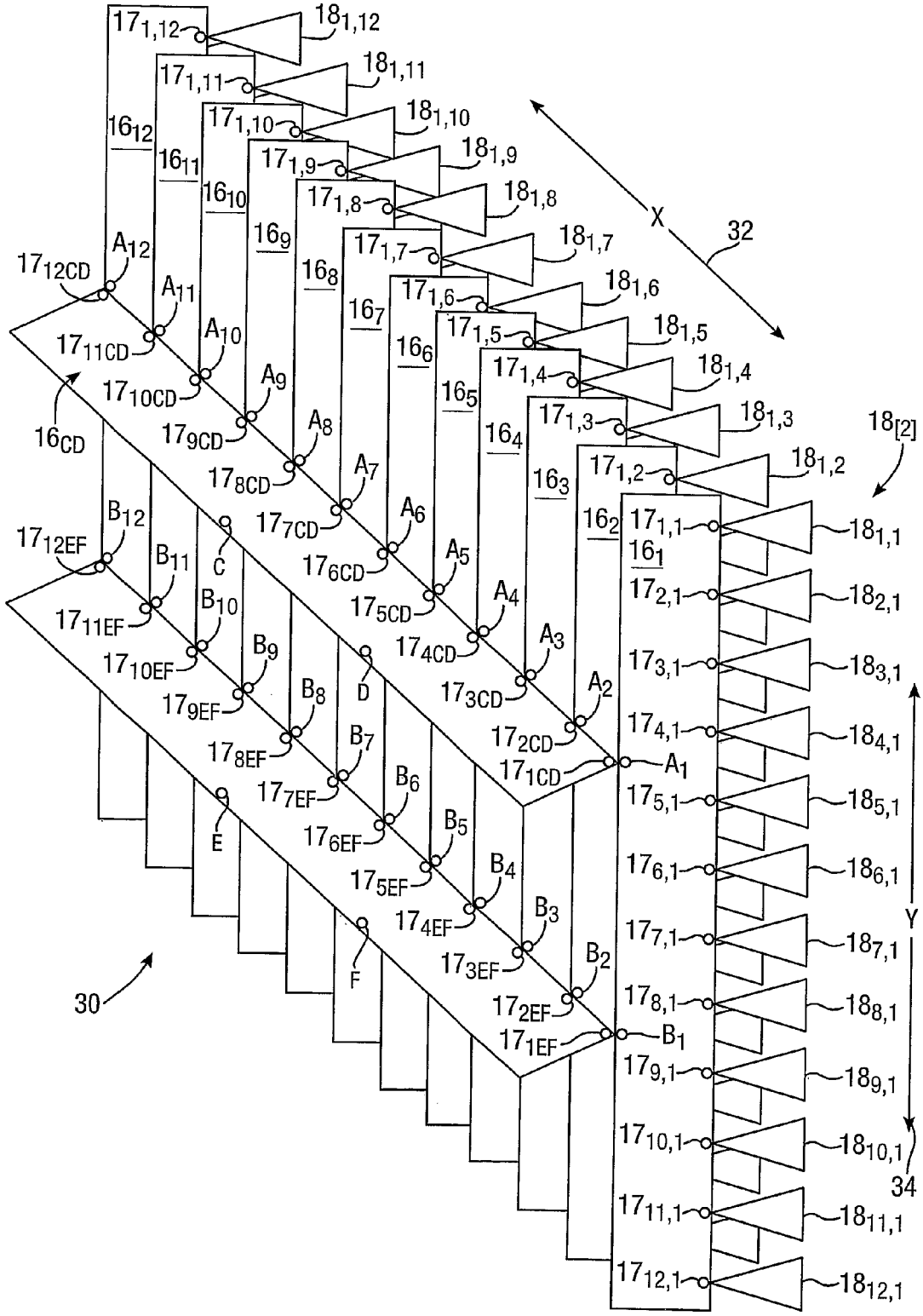
FIG. 2 is a functional drawing of an embodiment of an antenna system of the invention suitable for two dimensional beam scanning.

Referring now to FIG. 2, there is shown a generalised block diagram representation of an embodiment of the invention, i.e. a phased array antenna system 30 providing two dimensional antenna beam scanning. Parts equivalent to those described earlier are like—referenced with changes to subscript indices as appropriate.

The antenna system 30 has a two dimensional planar array 18[2] of one hundred and forty-four antenna elements $\mathbf{18}_{1,1}$ to $\mathbf{18}_{12,12}$ (only partially shown) arranged in twelve columns or vertical lines (e.g. first column or line $\mathbf{18}_{1,1}$ to $\mathbf{18}_{12,1}$) with twelve antenna elements (e.g. $\mathbf{18}_{1,1}$) per column. The array 18[2] has X and Y scan directions indicated by bidirectional arrows 32 and 34, which are respectively orthogonal and parallel to antenna element columns. Antenna elements $\mathbf{18}_{1,1}$ to $\mathbf{18}_{12,1}$ in a first column are connected to respective outputs $\mathbf{17}_{1,1}$ to $\mathbf{17}_{12,1}$ of a first splitter and vector combiner unit $\mathbf{16}_1$ in a first rank $\mathbf{16}_1$ to $\mathbf{16}_{12}$ of twelve such units. Likewise, antenna elements $\mathbf{18}_{1,2}$ to $\mathbf{18}_{12,12}$ in other columns (e.g. second column elements $\mathbf{18}_{1,2}$ to $\mathbf{18}_{12,2}$) are connected to outputs of eleven other splitter and vector combiner units $\mathbf{16}_2$ to $\mathbf{16}_{12}$ in the first rank respectively; i.e. antenna elements $\mathbf{18}_{1,j}$ to $\mathbf{18}_{12,j}$ in a jth column are connected to respective output terminals $\mathbf{17}_{1,j}$ to $\mathbf{17}_{12,j}$ of a jth splitter and vector combiner unit $\mathbf{16}_j$ (j=1 to 12). Connection of first rank splitter and vector combiner units $\mathbf{16}_1$ to $\mathbf{16}_{12}$ to antenna element columns is shown for convenience; as the system 30 could be rotated through 90° to exchange rows for columns.

The first rank splitter and vector combiner units $\mathbf{16}_1$ to $\mathbf{16}_{12}$ have respective A and B inputs A1/B1 to A12/B12. The antenna system 30 has two further splitter and vector combiner units forming a second rank of such units, i.e. thirteenth and fourteenth splitter and vector combiner units $\mathbf{16}_{CD}$ and $\mathbf{16}_{EF}$ with output terminals $\mathbf{17}_{1CD}$ to $\mathbf{17}_{12CD}$ and $\mathbf{17}_{1EF}$ to $\mathbf{17}_{12EF}$ respectively. The two ranks of splitter and vector combiner units are connected in cascade as follows. The A inputs A1 to A12 of the first rank vector combiner units $\mathbf{16}_1$ to $\mathbf{16}_{12}$, i.e. a line of upper inputs to these units, are connected to output terminals $\mathbf{17}_{1CD}$ to $\mathbf{17}_{12CD}$ of the thirteenth splitter and vector combiner unit $\mathbf{16}_{CD}$ respectively; similarly the B inputs B1 to B12 of the first rank vector splitter and vector combiner units $\mathbf{16}_1$ to $\mathbf{16}_{12}$, i.e. a line of lower inputs to these units, are connected respectively to output terminals $\mathbf{17}_{1EF}$ to $\mathbf{17}_{12EF}$ of the fourteenth splitter and vector combiner unit $\mathbf{16}_{EF}$. The thirteenth splitter and vector combiner unit $\mathbf{16}_{CD}$ has inputs C and D equivalent to inputs A and B in the prior art described with reference to FIG. 1; similarly the fourteenth splitter and vector combiner unit $\mathbf{16}_{EF}$ has likewise equivalent inputs E and F.

Figure 3:
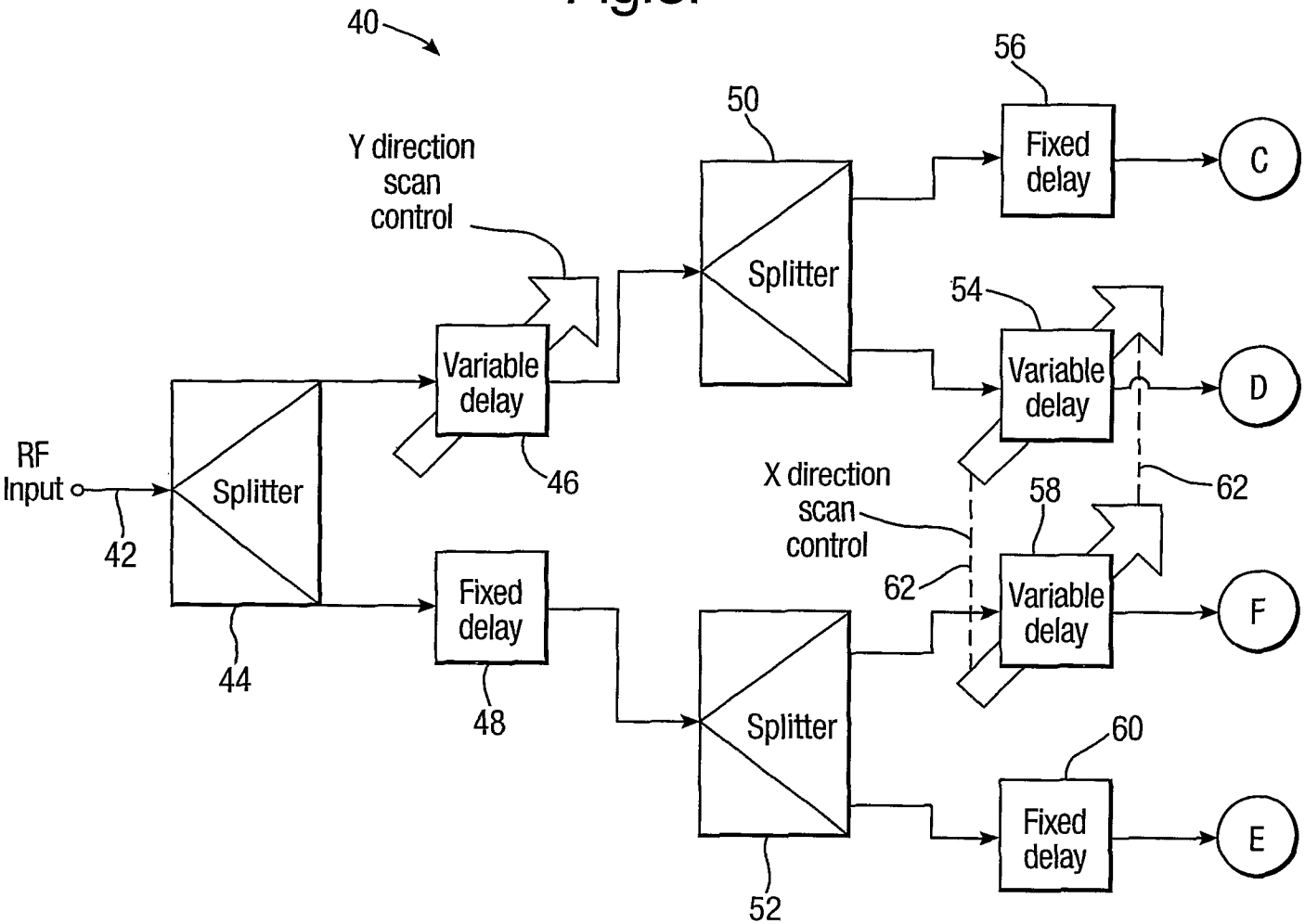
FIG. 3 illustrates signal phase control circuitry for the FIG. 2 antenna system.

Control of scanning of the antenna array 18[2] in two dimensions in a system of the invention requires more complex signal phasing arrangements than in the prior art, and this will now be described with reference to FIG. 3, in which parts equivalent to those described earlier are like-referenced. FIG. 3 illustrates a scan control apparatus 40 for supplying signals to terminals referenced C, D, E and F, which are also the inputs C/D, E/F of the thirteenth and fourteenth splitter and vector combiner units $\mathbf{16}_{CD}$ and $\mathbf{16}_{EF}$ respectively.

The apparatus 40 has an RF input 42 connected to a first splitter 44, which splits an RF input signal into two divided signals fed to a first variable delay 46 and a first fixed delay 48 respectively. Signals pass from the first variable delay 46 and the first fixed delay 48 to second and third splitters 50 and 52 respectively. In this specification delays (delay devices) and phase shifts (phase shifters) are treated as synonymous.

The second splitter 50 divides the signal from the first variable delay 46 into two signals which pass to a second variable delay 54 and a second fixed delay 56 respectively. Similarly, the third splitter 52 divides the signal from the first fixed delay 48 into two signals which pass to a third variable delay 58 and a third fixed delay 60 respectively. The second and third variable delays 54 and 58 are operatively ganged as indicated by dotted lines 62 so that signals reaching them are delayed for time intervals which are both variable and remain equal to one another.

Signals from the second fixed delay 56 and the second variable delay 54 pass respectively to the inputs C and D of the thirteenth splitter and vector combiner unit $\mathbf{16}_{CD}$. Similarly, signals from the third variable delay 58 and the third fixed delay 60 pass respectively to the inputs F and E of the fourteenth splitter and vector combiner unit $\mathbf{16}_{EF}$.

Connections from the second fixed delay 56 and the second variable delay 54 to the inputs C and D may be exchanged, provided that connections from the third variable delay 58 and the third fixed delay 60 to the inputs F and E are also exchanged likewise.

By inspection of FIG. 3, operation of the first variable delay 46 produces equal phase changes in signals reaching terminals C and D, and these phase changes are relative to signals reaching terminals E and F which are unaffected. Similarly, operation of the ganged second and third variable delays 54 and 58 produces equal phase changes in the signals reaching terminals D and F, and these phase changes are relative to the signals reaching terminals C and E which are unaffected. This is relevant to antenna beam scanning in two dimensions: i.e. the first variable delay 46 provides scan control in the Y direction 34 for the phased array antenna system 30; the ganged second and third variable delays 54 and 58 collectively provide a scan control in the X direction 32. This will be described later in more detail.

Figure 4:
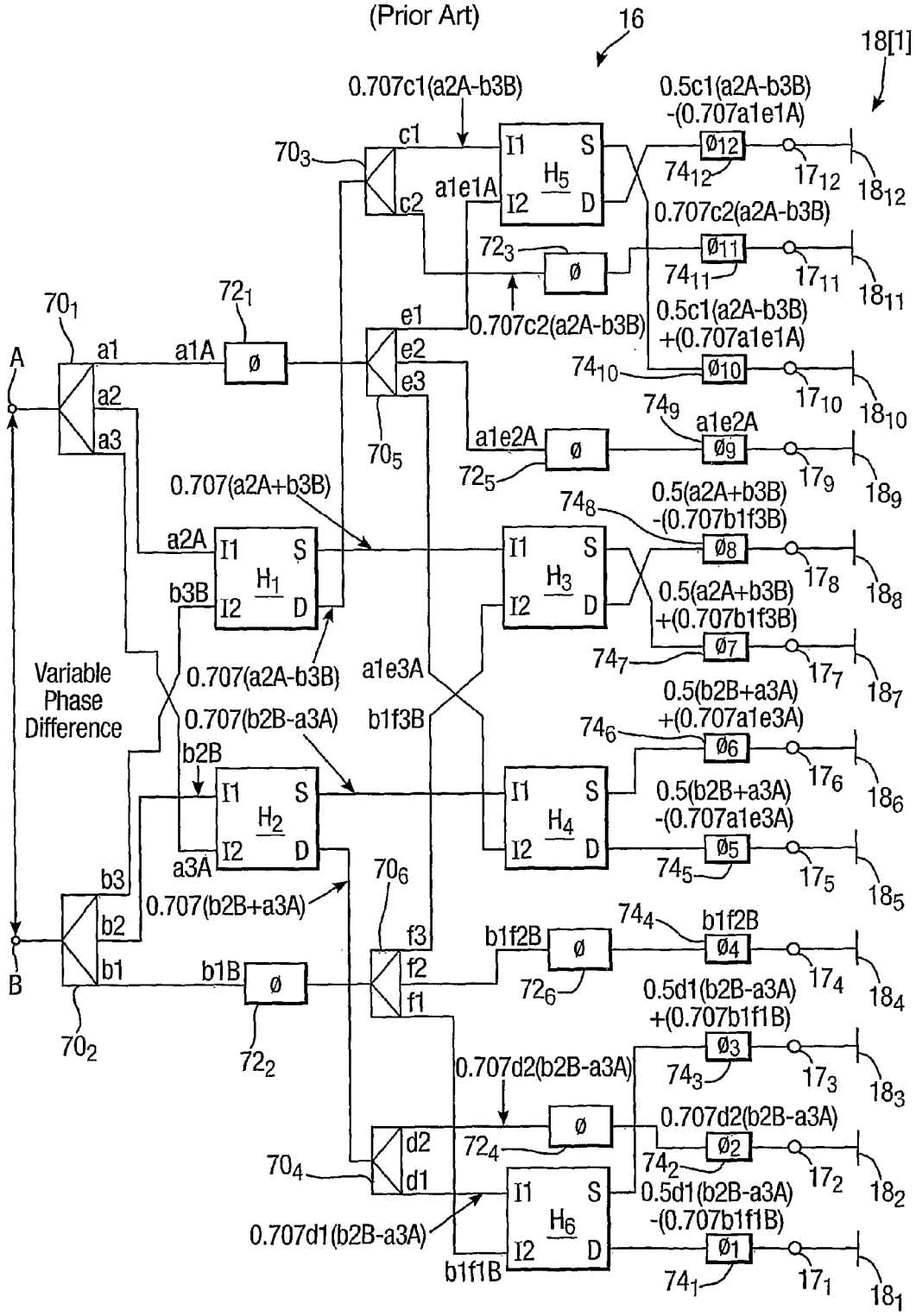
Fig.4. (Prior Art)
FIG. 4 is a block diagram of a prior art antenna corporate feed network which provides two signals with variable relative phasing and which may be used in the FIG. 2 antenna system.

Referring now to FIG. 4, there is shown an implementation of a prior art splitter and vector combiner circuit 16 of FIG. 1 suitable for use with a one dimensional phased array 18[1] with twelve antenna elements $\mathbf{18}_1$ to $\mathbf{18}_{12}$ arranged in a vertical line. Parts equivalent to those previously described are like-referenced. First and second splitters $\mathbf{70}_1$ and $\mathbf{70}_2$ respectively receive input signals denoted by vectors A and B: these vectors are of equal power but variable relative phase. The splitters $\mathbf{70}_1$ and $\mathbf{70}_2$ implement division into three fractions a1/a2/a3 and b1/b2/b3 respectively: i.e. signals a1A, a2A and a3A are output from splitter $\mathbf{70}_1$ and signals b1B, b2B and b3B from splitter $\mathbf{70}_2$. Values for the fractions a1/a2/a3 and b1/b2/b3 (and also fractions c1/c2, d1/d2, e1/e2/e3 and f1/f2/f3 mentioned below) are given in the prior art, and can also be calculated from simple circuit and antenna phasing considerations by one of ordinary skill in the art.

Signals a1A and b1B pass to first and second Φ padding phase shifters $\mathbf{72}_1$ and $\mathbf{72}_2$ respectively. Here "padding" indicates a component introduced to compensate for phase shifts experienced by other signals. Signals a2A and b3B pass to I1 and I2 inputs of a first 180 degree hybrid directional coupler $H_1$ referred to as a "sum and difference hybrid" or "hybrid". Such hybrids have the property of providing at two outputs S and D signals equal respectively to the sum and difference of signals at two inputs I1 and I2.

Signals b2B and a3A pass to I1 and I2 inputs of a second hybrid $H_2$. The hybrids $H_1$ and $H_2$ have difference outputs D connected as inputs to third and fourth splitters $\mathbf{70}_3$ and $\mathbf{70}_4$, which produce two-way splitting into fractions c1/c2 and d1/d2 respectively. They also have sum outputs S connected to I1 inputs of third and fourth hybrids $H_3$ and $H_4$ respectively.

Output signals from the first and second phase shifters $\mathbf{72}_1$ and $\mathbf{72}_2$ pass to fifth and sixth splitters $\mathbf{70}_5$ and $\mathbf{70}_6$ producing three-way splitting into fractions e1/e2/e3 and f1/f2/f3 respectively. Output signals from the third splitter $\mathbf{70}_3$ pass (fraction c1) to an I1 input of a fifth hybrid $H_5$ and (fraction c2) to a third Φ padding phase shifter $\mathbf{72}_3$. Output signals from the fourth splitter $\mathbf{70}_4$ pass (fraction d1) to an I1 input of a sixth hybrid $H_6$ and (fraction d2) to a fourth Φ padding phase shifter $\mathbf{72}_4$. Output signals from the fifth splitter $\mathbf{70}_5$ pass (fraction e1) to an I2 input of the fifth hybrid $H_5$, (fraction e2) to a fifth Φ padding phase shifter $\mathbf{72}_5$ and (fraction e3) to an I2 input of the fourth hybrid $H_4$. Output signals from the sixth splitter $\mathbf{70}_6$ pass (fraction f1) to an I2 input of the sixth hybrid $H_6$, (fraction f2) to a sixth Φ padding phase shifter $\mathbf{72}_6$ and (fraction f3) to a I2 input of the third hybrid $H_3$. Via respective fixed phase shifters $\mathbf{74}_1$ to $\mathbf{74}_{12}$ and terminals $\mathbf{17}_1$ to $\mathbf{17}_{12}$, the antenna elements $\mathbf{18}_1$ to $\mathbf{18}_{12}$ receive drive signals from outputs of the third to sixth hybrids $H_3$ and $H_6$ and third to sixth phase shifters $\mathbf{72}_3$ and $\mathbf{72}_6$ as set out in the Signal Amplitude Table below.

Signal Amplitude Table

| Element | Hybrid or Phase Shifter | Signal Amplitude |
|---|---|---|
| $18_1$ | Hybrid $H_6$, output D | 0.5d1(b2B − a3A) − 0.707b1f1B |
| $18_2$ | Phase Shifter $72_4$ | 0.707d2(b2B − a3A) |
| $18_3$ | Hybrid $H_6$, output S | 0.5d1(b2B − a3A) + 0.707b1f1B |
| $18_4$ | Phase Shifter $72_6$ | b1f2B |
| $18_5$ | Hybrid $H_4$, output D | 0.5(b2B + a3A) − 0.707a1e3A |
| $18_6$ | Hybrid $H_4$, output S | 0.5(b2B + a3A) + 0.707a1e3A |
| $18_7$ | Hybrid $H_3$, output S | 0.5(a2A + b3B) + 0.707b1f3B |
| $18_8$ | Hybrid $H_3$, output D | 0.5(a2A + b3B) − 0.707b1f3B |
| $18_9$ | Phase Shifter $72_5$ | a1e2A |
| $18_{10}$ | Hybrid $H_5$, output S | 0.5c1(a2A − b3B) + 0.707a1e1A |
| $18_{11}$ | Phase Shifter $72_4$ | 0.707c2(a2A − b3B) |
| $18_{12}$ | Hybrid $H_5$, output D | 0.5c1(a2A − b3B) − 0.707a1e1A |

Because all the terms a1 to f3 are fractions, all signal powers are in terms of fractions of signal vectors A and B input to the first and second splitters $\mathbf{70}_1$ and $\mathbf{70}_2$ respectively.

The phase shifters $\mathbf{72}_1$ to $\mathbf{72}_6$ provide compensation for the phase shift that takes place in hybrids (e.g. $H_1$). Consequently, signals or signal components that do not pass via one or more hybrids traverse two phase shifters (e.g. $\mathbf{72}_1$) and receive a phase shift of 2Φ before reaching antenna elements $\mathbf{18}_3$ and $\mathbf{18}_9$. In addition, signals or signal components that pass via one hybrid traverse one phase shifter (e.g. $72_4$) and receive a relative phase shift of Φ before reaching antenna elements (e.g. $18_2$).

Figure 5:
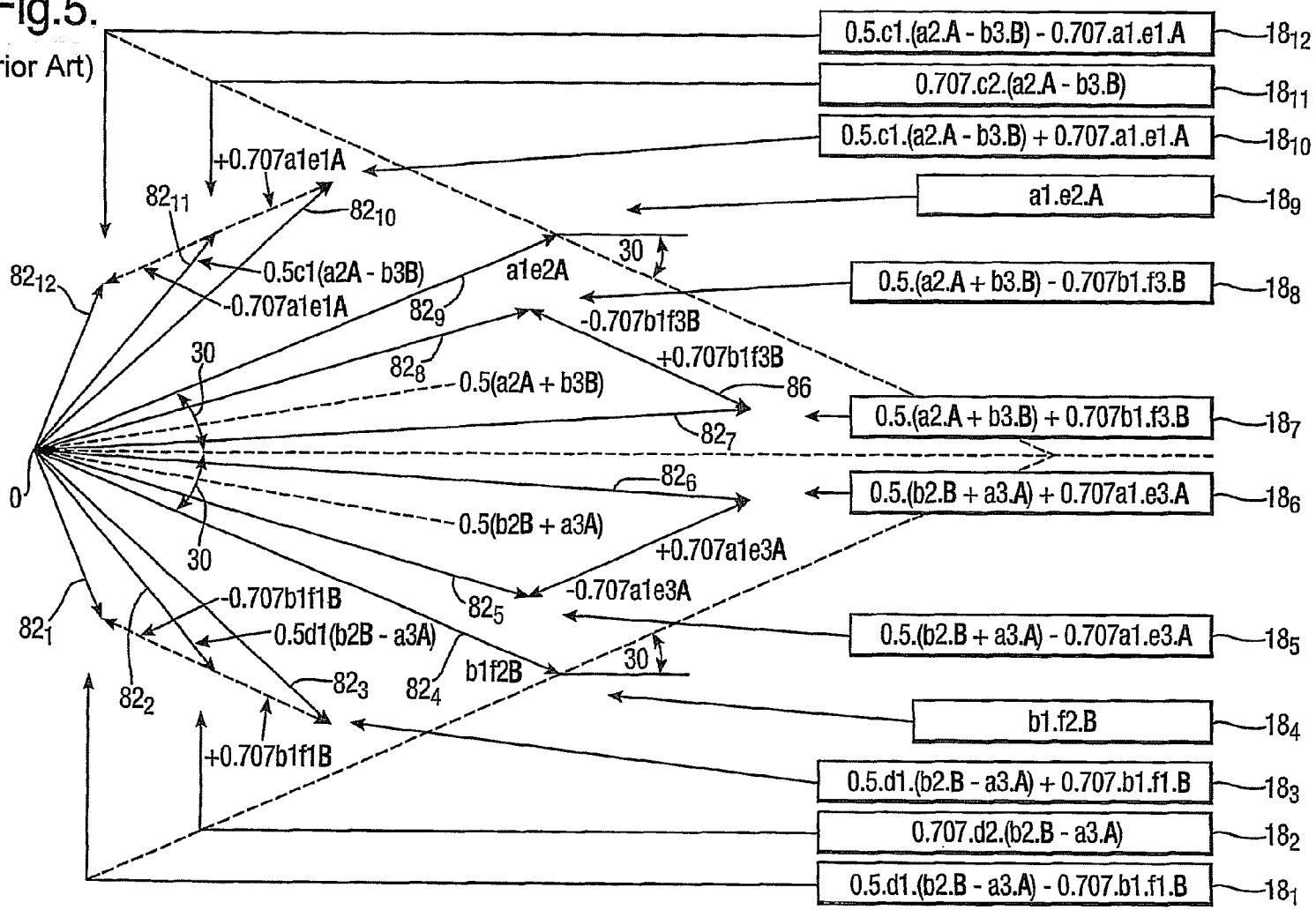
Fig.5. (Prior Art)
FIG. 5 illustrates antenna element signal phasing using the corporate feed network of FIG. 4.

Referring now also to FIG. 5, there is shown a vector diagram for the array 18 of antenna elements $18_1$ to $18_{12}$ when the phase difference between input signal vectors A and B is 60 degrees: in this example 60 degrees is the angle at which the antenna array 18 has an optimum phase front. Drive signals for antenna elements $18_1$ to $18_{12}$ respectively are indicated in magnitude and phase by solid radius vector arrows $82_1$ to $82_{12}$ extending from a common origin O and marked to indicate signal fractions (e.g. a1*e*2A). Bi-directional arrows such as 86 indicate phase differences between adjacent radius vectors.

Components (e.g. 0.707a1*e*1A) of such signals are indicated by chain or dotted line vectors. Signals b1*f*2B and a1*e*2A on respective antenna elements $18_4$ and $18_9$ are fractions of and are in phase with input signal vectors A and B, and they are 60 degrees apart in phase as indicated by two bi-directional arrows each associated with a respective 30 degree angle marking.

When the phase difference between signals A and B is altered by operation of the variable phase shifter 12, the phases of signals on individual antenna elements $18_1$ to $18_{12}$ change: this changes the direction of the antenna main lobe or beam to provide phased array beam steering.

Referring to FIG. 4 once more, on comparing this drawing with FIGS. 2 and 3, inputs A1 to A12, C and E of splitter and vector combiner units $16_1$ to $16_{12}$, $16_{CD}$ and $16_{EF}$ are equivalent to the A input to upper half first splitter $70_1$. Similarly, inputs B1 to B12, D and F of splitter and vector combiner units $16_1$ to $16_{12}$, $16_{CD}$ and $16_{EF}$ are equivalent to the B input to lower half second splitter $70_2$.

By inspection of FIG. 4 and the Signal Amplitude Table, the splitter and vector combiner circuit 16 is what is referred to as an antenna corporate feed network: this corporate feed network converts input signal vectors A and B into different signal vectors given by expressions of the form:

$$p_iA+q_iB \tag{1}$$

where $p_i$ and $q_i$ are numerical factors which (if real) take values in the range −1 to 1, and i indicates a signal supplied to an ith output $17_i$. The factors $p_i$ and $q_i$ might alternatively be complex numbers, in which case their moduli would be in the range 0 to 1.

Referring now also to FIG. 2 once more, signal vectors C, D, E and F are now used to represent input signals at respective inputs C, D, E and F of splitter and vector combiner circuits $16_{CD}$ and $16_{EF}$. All the splitter and vector combiner circuits are assumed to apply the same values of $p_i$ and $q_i$. Applying Expression (1) above to the signal vectors C, D, E and F to express the action of the splitter and vector combiner circuits leads to the following:

(a) the thirteenth splitter and vector combiner unit $16_{CD}$ provides its twelve outputs $17_{1CD}$ to $17_{12CD}$ with signals represented by vector sums $(p_1C+q_1D)$ to $(p_{12}C+q_{12}D)$; i.e. the ith output $17_{iCD}$ receives a signal $(p_iC+q_iD)$, i=1 to 12;

(b) similarly, the fourteenth splitter and vector combiner unit $16_{EF}$ provides its twelve outputs $17_{1EF}$ to $17_{12EF}$ with signals represented by vector sums $(p_1E+q_1F)$ to $(p_{12}E+q_{12}F)$; i.e. the ith output $17_{iEF}$ receives a signal $(p_iE+q_iF)$, i=1 to 12.

Expression (1) above is now applied to the signal vectors $(p_1C+q_1D)$ and $(p_1E+q_1F)$ input respectively from $17_{1CD}$ and $17_{1EF}$ to inputs A1 and B1 of the first splitter and vector combiner circuit $16_1$. This leads to the circuit $16_1$ producing the following signal vectors $\{p_1(p_1C+q_1D)+q_1(p_1E+q_1F)\}$ to $\{p_{12}(p_1C+q_1D)+q_{12}(p_1E+q_1F)\}$, which appear at outputs $17_{1,1}$ to $17_{12,1}$ connected to first column antenna elements $18_{1,1}$ to $18_{12,1}$ respectively. At the ith output of the first splitter and vector combiner circuit $16_1$ and at the first column antenna element $18_{i,1}$ (i=1 to 12), a signal vector given by the following expression appears:

$$p_i(p_1C+q_1D)+q_i(p_1E+q_1F) \tag{2}$$

Varying the first variable delay 46 in FIG. 3 varies the phases of both C and D by the same amount relative to both E and F, but does not vary the phase of either C relative to D or E relative to F. The terms $(p_1C+q_1D)$ and $(p_1E+q_1F)$ in parenthesis in Expression (2) are resultant vectors arising from vector addition, and they are respectively equivalent to vectors A and B in Expression (1). Varying the first variable delay 46 therefore varies the phase of a signal represented by the vector $(p_1C+q_1D)$ (equivalent to vector A in Expression (1)) relative to a signal represented by the vector $(p_1E+q_1F)$ (equivalent to vector B), but does not otherwise affect these signals: Expression (2) is therefore equivalent to Expression (1). With appropriate values of $p_i$ and $q_i$ varying along a vertical line or column of antenna elements $18_{1,1}$ to $18_{12,1}$ as in the prior art, Expression (1) provides for an antenna output beam to be steered in a vertical plane (Y direction 34 in the drawing) by changing the relative phase difference or delay between two signal vectors equivalent to A and B. Consequently, varying the first variable delay 46 provides beam steering in a vertical plane in the same way for the first column of antenna elements $18_{1,1}$ to $18_{12,1}$.

Similar remarks apply to the variation of the first variable delay 46 in connection with beam steering in a vertical plane for other columns of antenna elements $18_{1,j}$ to $18_{12,j}$ (j=2 to 12): for the jth column the terms in parenthesis in Expression (2) become $(p_jC+q_jD)$ and $(p_jE+q_jF)$. However, differing values of $(p_jC+q_jD)$ and $(p_jE+q_jF)$ for different columns only affect signal vector resultants equivalent to vector A or B; the phase difference between $(p_jC+q_jD)$ and $(p_jE+q_jF)$ introduced by the first variable delay 46 equivalently affects signal vector resultants supplied to equivalently located antenna elements in different columns. Varying the first variable delay 46 therefore provides beam steering in a vertical plane in the same way for all twelve columns of antenna elements $18_{1,j}$ to $18_{12,j}$ (j=1 to 12), and an equivalent of Expression (2) for any of the twelve columns is given by replacing index 1 by index j as follows:

$$p_i(p_jC+q_jD)+q_i(p_jE+q_jF) \tag{3}$$

where $p_i$ and $q_i$ are numerical factors imposed by the first to tenth splitter and vector combiner circuits $16_1$ to $16_{12}$, and $p_j$ and $q_j$ are equivalents of $p_i$ and $q_i$ imposed by the thirteenth and fourteenth splitter and vector combiner circuits $16_{CD}$ and $16_{EF}$.

Turning now to the effect produced by varying the ganged second and third variable delays 54 and 58, Expression (3) is rearranged so that index i terms appear in parenthesis and index j terms outside as follows:

$$p_j(p_iC+q_iE)+q_j(p_iD+q_iF) \tag{4}$$

Varying the ganged second and third variable delays 54 and 58 varies the phases of both D and F by the same amount relative to both C and E, but does not vary the phase of either C relative to E or D relative to F. This therefore varies the phase of a signal represented by the vector $(p_iC+q_iE)$ (equivalent to vector A in Expression (1)) relative to a signal represented by the vector $(p_iD+q_iF)$ (equivalent to vector B), but does not otherwise affect these signals: just as Expression (3)

therefore, Expression (4) is also equivalent to Expression (1). With appropriate values of $p_j$ and $q_j$ varying along an ith row (horizontal line) of antenna elements $\mathbf{18}_{i,1}$ to $\mathbf{18}_{i,12}$ (i=1 to 12), Expression (4) provides for an antenna output beam from that row to be steered in a horizontal plane (X direction 32 in the drawing) by changing the relative phase difference or delay between two signal vectors equivalent to vectors A and B. Similar remarks apply to horizontal steering of antenna output beams from all rows of antenna elements, $\mathbf{18}_{1,1}$ to $\mathbf{18}_{1,12}$, . . . $\mathbf{18}_{i,1}$ to $\mathbf{18}_{i,12}$, . . . $\mathbf{18}_{12,1}$ to $\mathbf{18}_{12,12}$.

Consequently the two dimensional phased array antenna system 30 provides scanning of the antenna beam direction in both dimensions.

A more detailed treatment of the theoretical basis for the invention's two dimensional scanning of the antenna beam direction is as follows. Initially it is helpful to derive a lemma or result for use later:

$$\begin{aligned} g\sin(A+B)+h\sin(A-B) = {} & = g\sin A\cos B + g\cos A\sin B + \\ & h\sin A\cos B - h\cos A\sin B \\ & = (g+h)\sin A\cos B + (g-h)\cos A\sin B \\ & = (((g+h)\cos B)^2 + ((g-h)\sin B)^2)^{\frac{1}{2}} \\ & \sin\left(A + \tan^{-1}\left(\left(\frac{g-h}{g+h}\right)\frac{\sin B}{\cos B}\right)\right) \\ & = (g^2+h^2+2gh(\cos^2 B - \sin^2 B))^{\frac{1}{2}} \\ & \sin\left(A + \tan^{-1}\left(\left(\frac{g-h}{g+h}\right)\tan B\right)\right) \\ & = (g^2+h^2+2gh\cos 2B)^{\frac{1}{2}} \\ & \sin\left(A + \tan^{-1}\left(\left(\frac{g-h}{g+h}\right)\tan B\right)\right) \end{aligned} \tag{5}$$

With an input signal at 42 denoted by V sin ωt, the scan control apparatus 40 described with reference to FIG. 3 provides signals $V_C$, $V_D$, $V_E$ and $V_F$ at terminals C, D, E and F, which are also like-referenced inputs of the thirteenth and fourteenth splitter and vector combiner units $\mathbf{16}_{CD}$ and $\mathbf{16}_{EF}$ respectively. The signals $V_C$, $V_D$, $V_E$ and $V_F$ are given by:

$$\begin{aligned} V_C &= \frac{V}{2}\sin\left(\omega t + \frac{\varphi}{2} - \frac{\phi}{2}\right) \\ V_D &= \frac{V}{2}\sin\left(\omega t + \frac{\varphi}{2} + \frac{\phi}{2}\right) \\ V_E &= \frac{V}{2}\sin\left(\omega t - \frac{\varphi}{2} - \frac{\phi}{2}\right) \\ V_F &= \frac{V}{2}\sin\left(\omega t - \frac{\varphi}{2} + \frac{\phi}{2}\right) \end{aligned} \tag{6}$$

where:

V is a constant;

Φ is a variable phase difference controlling antenna beam scanning in the horizontal plane indicated by X; and ϕ is a variable phase difference controlling scan in the vertical plane indicated by Y.

The numerical factor ½ multiplying V in Equations (6) arises from the fact that signals experience two splitters in cascade reducing their power to one quarter.

The signals $V_C$, $V_D$, $V_E$ and $V_F$ are now rewritten as:

$$\begin{aligned} V_C &= \frac{V}{2}\sin\left(\left[\omega t + \frac{\varphi}{2}\right] - \frac{\phi}{2}\right) \\ V_D &= \frac{V}{2}\sin\left(\left[\omega t + \frac{\varphi}{2}\right] + \frac{\phi}{2}\right) \\ V_E &= \frac{V}{2}\sin\left(\left[\omega t - \frac{\varphi}{2}\right] - \frac{\phi}{2}\right) \\ V_F &= \frac{V}{2}\sin\left(\left[\omega t - \frac{\varphi}{2}\right] + \frac{\phi}{2}\right) \end{aligned} \tag{7}$$

Antennas array columns are now numbered with subscript j and rows with subscript i.

Then an input signal $V_{Aj}$ to each of the A or upper inputs $A_1$ to $A_{12}$ of the twelve first rank splitter and vector combiner units $\mathbf{16}_1$ to $\mathbf{16}_{12}$ is given by:

$$\begin{aligned} V_{Aj} &= c_j V_C + d_j V_D \\ V_C &= \frac{V}{2}\sin\left(\left[\omega t + \frac{\varphi}{2}\right] - \frac{\phi}{2}\right) \\ V_D &= \frac{V}{2}\sin\left(\left[\omega t + \frac{\varphi}{2}\right] + \frac{\phi}{2}\right) \\ V_{Aj} &= \frac{c_j V}{2}\sin\left(\left[\omega t + \frac{\varphi}{2}\right] - \frac{\phi}{2}\right) + \frac{d_j V}{2}\sin\left(\left[\omega t + \frac{\varphi}{2}\right] + \frac{\phi}{2}\right) \end{aligned} \tag{8}$$

By using the lemma mentioned previously, Equations (8) can be rewritten as:

$$V_{Aj} = \frac{V}{2}(c_j^2 + d_j^2 + 2c_j d_j\cos\phi)^{\frac{1}{2}}\sin\left(\left[\omega t + \frac{\varphi}{2}\right] + \tan^{-1}\left(\left(\frac{d_j - c_j}{d_j + c_j}\right)\tan\frac{\phi}{2}\right)\right) \tag{9}$$

Similarly for an input signal $V_{Bj}$ to each of the B or lower inputs $B_1$ to $B_{12}$ of the twelve first rank splitter and vector combiner units $\mathbf{16}_1$ to $\mathbf{16}_{12}$ is given by:

$$V_{Bj} = \frac{V}{2}(c_j^2 + d_j^2 + 2c_j d_j\cos\phi)^{\frac{1}{2}}\sin\left(\left[\omega t - \frac{\varphi}{2}\right] + \tan^{-1}\left(\left(\frac{d_j - c_j}{d_j + c_j}\right)\tan\frac{\phi}{2}\right)\right) \tag{10}$$

Rearranging brackets in Equations (9) and (10):

$$\begin{aligned} V_{Aj} = {} & \\ & \frac{V}{2}(c_j^2 + d_j^2 + 2c_j d_j\cos\phi)^{\frac{1}{2}}\sin\left(\left[\omega t + \tan^{-1}\left(\left(\frac{d_j - c_j}{d_j + c_j}\right)\tan\frac{\phi}{2}\right)\right] + \frac{\varphi}{2}\right) \\ V_{Bj} = {} & \frac{V}{2}(c_j^2 + d_j^2 + 2c_j d_j\cos\phi)^{\frac{1}{2}}\sin\left(\left[\omega t + \tan^{-1}\left(\left(\frac{d_j - c_j}{d_j + c_j}\right)\tan\frac{\phi}{2}\right)\right] - \frac{\varphi}{2}\right) \end{aligned} \tag{11}$$

Consequently, the general antenna element $\mathbf{18}_{i,j}$ in the ith row and jth column receives a signal $V_{ij}$ given by:

$$\begin{aligned} V_{ij} &= a_i V_{Aj} + b_i V_{Bj} \\ V_{ij} &= \\ & \frac{a_i V}{2}(c_j^2 + d_j^2 + 2c_j d_j\cos\phi)^{\frac{1}{2}}\sin\left(\left[\omega t + \tan^{-1}\left(\left(\frac{d_j - c_j}{d_j + c_j}\right)\tan\frac{\phi}{2}\right)\right] + \frac{\varphi}{2}\right) + \end{aligned} \tag{12}$$

-continued $$\frac{b_i V}{2}(c_j^2+d_j^2+2c_jd_j\cos\phi)^{\frac{1}{2}}\sin\left(\left[\omega t+\tan^{-1}\left(\left(\frac{d_j-c_j}{d_j+c_j}\right)\tan\frac{\phi}{2}\right)\right]-\frac{\varphi}{2}\right)$$

Applying the aforementioned lemma to Equation (12) produces:

$$V_{ij}=\frac{V}{2}(c_j^2+d_j^2+2c_jd_j\cos\phi)^{\frac{1}{2}}(a_i^2+b_i^2+2a_ib_i\cos\varphi)^{\frac{1}{2}}\sin\left(\omega t+\tan^{-1}\left(\left(\frac{d_j-c_j}{d_j+c_j}\right)\tan\frac{\phi}{2}\right)+\tan^{-1}\left(\left(\frac{a_i-b_i}{a_i+b_i}\right)\tan\frac{\varphi}{2}\right)\right) \quad (13)$$

If θ is small then:
cos θ≈1, tan θ≈θ, and n tan θ≈ tan nθ≈n,
and hence:

$$V_{ij}=\frac{V}{2}(c_j^2+d_j^2+2c_jd_j)^{\frac{1}{2}}(a_i^2+b_i^2+2a_ib_i)^{\frac{1}{2}}\sin\left(\omega t+\left(\frac{d_j-c_j}{d_j+c_j}\right)\frac{\phi}{2}+\left(\frac{a_i-b_i}{a_i+b_i}\right)\frac{\varphi}{2}\right) \quad (14)$$

$$V_{ij}=\frac{V}{2}(c_j+d_j)(a_i+b_i)\sin\left(\omega t+\left(\frac{d_j-c_j}{d_j+c_j}\right)\frac{\phi}{2}+\left(\frac{a_i-b_i}{a_i+b_i}\right)\frac{\varphi}{2}\right)$$

if the spatial coordinates of antenna element $\mathbf{18}_{i,j}$ are $x_{ij}$, $y_{ij}$, where $\Sigma x_{ij}=0=\Sigma y_{ij}$, (i.e. the coordinates are referred to a centre in the middle of an evenly spaced rectangular array of antenna elements $\mathbf{18}_{1,1}$ etc.) and splitter ratios are then set so that:

$$\gamma_x x_{ij}=2\frac{d_j-c_j}{d_j+c_j} \quad (15)$$

where $\gamma_x$ is a gearing ratio in the $X$ direction and $$\gamma_y y_{ij}=2\frac{a_i-b_i}{a_i+b_i}$$

where $\gamma_y$ is a gearing ratio in the $Y$ direction

Then the input signal phase on antenna element $\mathbf{18}_{i,j}$ in the ith row and jth column is:

$$x_{ij}\gamma_x\Phi+y_{ij}\gamma_y\phi \quad (16)$$

and the antenna array 18 generates a phase front which is substantially flat and tilted in both X and Y directions.

The foregoing analysis shows that the two dimensional phased array antenna system 30 provides scanning of the antenna beam direction in both dimensions. This is achieved with an example which uses two cascaded ranks of "few to many" corporate feed networks, i.e. splitter and vector combiner circuits $\mathbf{16}_1$ to $\mathbf{16}_{EF}$ (although it is also possible to use "few to many" corporate feed networks in one (first or second) rank coupled to another type of corporate feed network in the other (second or first) rank). A first rank of "few to many" corporate feed networks $\mathbf{16}_1$ to $\mathbf{16}_{12}$ (one such feed network per column) provides inputs to columns of antenna elements, and a second rank (two) of "few to many" corporate feed networks $\mathbf{16}_{CD}$ and $\mathbf{16}_{EF}$ provides inputs to the first rank, each second rank corporate feed network $\mathbf{16}_{CD}$ or $\mathbf{16}_{EF}$ providing one respective input (i.e. either Ai or Bi (i=1 to 12) but not both) to each first rank corporate feed network $\mathbf{16}_1$ to $\mathbf{16}_{12}$.

Scanning in the dimension in which extend antenna elements connected to first rank corporate feed networks is obtained by:

a) keeping constant both the phase difference between input signals to one second rank corporate feed network $\mathbf{16}_{CD}$ and the phase difference between input signals to the other second rank corporate feed network $\mathbf{16}_{EF}$; and b) varying the phase difference between each input signal to one second rank corporate feed network $\mathbf{16}_{CD}$ or $\mathbf{16}_{EF}$ and both input signals to the other second rank corporate feed network $\mathbf{16}_{EF}$ or $\mathbf{16}_{CD}$.

Scanning in the dimension orthogonal to that in which extend antenna elements connected to first rank corporate feed networks is obtained by:

c) keeping constant the phase difference between each input signal to one second rank corporate feed network $\mathbf{16}_{CD}$ or $\mathbf{16}_{EF}$ and a respective input signal to the other second rank corporate feed network $\mathbf{16}_{EF}$ or $\mathbf{16}_{CD}$, d) varying both the phase difference between input signals to one second rank corporate feed network $\mathbf{16}_{CD}$ and the phase difference between input signals to the other second rank corporate feed network $\mathbf{16}_{EF}$.

Implementing b) and d) above without a) and c) produces scanning at angles inclined to both rows and columns of the antenna array 30. Cross-coupling (as defined below) between control of scanning in the two different dimensions as above can be avoided if required by providing for the above phase control to maintain:

a) the phase difference between input signals to one second rank corporate feed network $\mathbf{16}_{CD}$ to be equal to the phase difference between input signals to the other second rank corporate feed network $\mathbf{16}_{EF}$; and b) the phase differences between each input signal to one second rank corporate feed network $\mathbf{16}_{CD}$ or $\mathbf{16}_{EF}$ and both input signals to the other second rank corporate feed network $\mathbf{16}_{EF}$ or $\mathbf{16}_{CD}$ to be equal.

Here cross-coupling means that an angle of deflection $\theta_x$ or $\theta_y$ of the antenna beam in one (X or Y) direction or dimension is altered when an angle of deflection $\theta_y$ or $\theta_x$ in the other (Y or X) direction or dimension is changed by scan control. This may be re-expressed using Equation (16), which indicates that $\theta_x$ varies with Φ and $\theta_y$ varies with φ during normal beam scanning. If cross-coupling is to be avoided, i.e. if it is required that $\theta_x$ does not vary with φ

$$\left(\text{i.e.}\ \frac{\partial\theta_x}{\partial\varphi}=0\right)$$

and $\theta_y$ does not vary with Φ

$$\left(\text{i.e.}\ \frac{\partial\theta_y}{\partial\phi}=0\right),$$

then the phase differences should be maintained equal as aforesaid. However, cross-coupling may be a useful feature in some circumstances.

The example of the invention described above employed corporate feed networks $\mathbf{16}_{11}$ to $\mathbf{16}_{EF}$ each with twelve outputs for convenience of illustration: i.e. these corporate feed networks acted as "two to twelve" signal converters. Corporate feed networks may have any convenient number of outputs, and in fact in the prior art a corporate feed network with twelve outputs is preferred to give advantageous performance in a phased array system; see WO 2004/102739 previously cited.

The invention is not limited to a "square" antenna array 30, i.e. an array having equal numbers of antenna elements in its rows and columns. The antenna array may for example be rectangular, i.e. it may have N antenna elements per row and M antenna elements per column, where N and M are positive integers and N≠M. Other antenna array geometries are also possible. A rectangular antenna array in particular is advantageous in applications requiring more antenna elements in the vertical dimension than in the horizontal dimension: examples of this include a mast-mounted antenna array for mobile telephones, in which beam width and extent of scan angle are required to be smaller in the vertical dimension (e.g. 15 degrees in elevation from a tower-mounted antenna array) compared to the like for the horizontal dimension (e.g. 120 degrees in azimuth).

The antenna array 30 is a planar array, but the invention is not limited to planar arrays. The invention may be implemented using an antenna array in which individual antenna elements have centres which are positioned to lie on or define a curved surface such as a cylindrical, spherical or toroidal surface. First rank corporate feed networks $\mathbf{16}_1$ to $\mathbf{16}_{12}$ connect to respective lines of antenna elements, but the lines need not be straight. The dimensions in which scanning is implemented may be orthogonal as described above, but may also be non-orthogonal: e.g. the rows of the antenna array 30 may be inclined to its columns by an angle θ which is not 90°: here again this generates cross coupling between control of angles of antenna beam deflection $\theta_x/\theta_y$ in different directions or dimensions. However the coupling may be counteracted by appropriate gearing of phase shifters. By combining phase shifting with various gearing one may swivel and dip an antenna beam, and indeed one may provide for the beam to sweep out a curve.

The embodiment of the invention described with reference to FIGS. 1 to 5 uses a "few to many" signal converter or corporate feed network where "few" is two. It is also possible to use a "few to many" signal converter or corporate feed network where "few" is more than two. As will be described, this increases complexity but is advantageous in increasing the range of angles over which an antenna beam can be steered.

Figure 6:
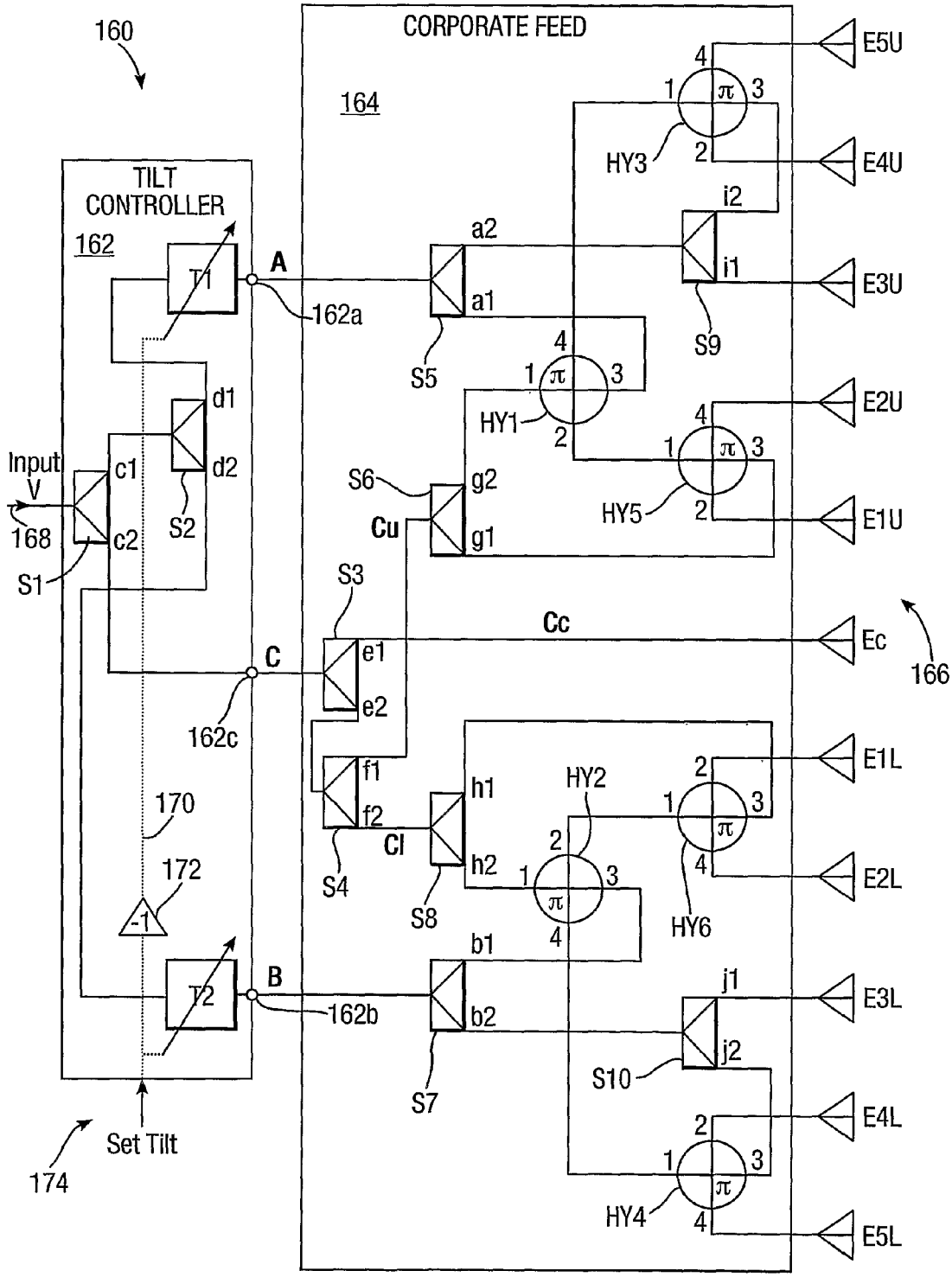
FIG. 6 is a block diagram of an electrical tilt controller providing three signals with variable relative phasing and an alternative form of antenna corporate feed network which accepts input of such signals and which may be used in an antenna system of the invention.

Referring now to FIG. 6, there is shown a splitter and vector combiner circuit 160 suitable for configuring one signal into three signals, two of which are variably delayed, and further configuring the three signals into eleven signals; the eleven signals are for respective antenna elements E1U to E5U, Ec and E1L to E5L of a one dimensional phased array 166 arranged in a vertical line. The circuit 160 is from GB 0622411.7 dated 10 Nov. 2006, Quintel Technology Ltd. It incorporates phase padding components (not shown) to equalize the phase shifts experienced by signals reaching antenna elements E1U to E5U, Ec and E1L to E5L after passing through it. This is known in the art and will not be described in detail (see e.g. WO 2004/102739): a signal route from an input to an antenna element incorporating hybrid couplers includes a phase shift of 180 degrees per coupler, so if the maximum number of couplers per signal route is n and the minimum is 0, a route including i couplers requires components for phase padding of 180(n−i) degrees.

The circuit 160 incorporates two main components, an electrical tilt controller 162 and a corporate feed 164, the latter connected to a phased array 166 antenna. The phased array antenna 166 has eleven antenna elements, these being a central antenna element Ec, five upper antenna elements E1U to E5U disposed successively above it, and five lower antenna elements E1L to E5L disposed successively below it.

An RF input signal represented as a vector V is applied to an input 168 of the tilt controller 162, in which it is split into two signal vectors c1.V and c2.V of differing amplitude by a first splitter S1 providing voltage split ratios c1 and c2. The signal vector c2.V is now designated as a tilt vector C, and appears at a controller output 162*c*.

The signal vector c1.V is further split by a second splitter S2 to provide first and second signal vectors c1.d1.V and c1.d2.V: the first signal vector c1.d1.V is delayed by a first variable delay T1 to give a signal vector which is now designated as a tilt vector A and appears at a controller output 162*a*; similarly, the second signal vector c1.d2.V is delayed by a second variable delay T2 to give a signal vector now designated as a tilt vector B and appearing at a controller output 162*b*.

Tilt controller 162 consequently provides three antenna tilt control signals, these signals representing tilt vectors A=c1.d1.V[T1], B=c1.d2.V[T2] and C=c2.V, where [T1], [T2] indicate variable delays T1, T2 respectively. Delays T1 and T2 are ganged as denoted by a dotted line 170, which contains a −1 amplifier symbol 172 indicating change in opposite senses; i.e. T1 increases from 0 to T when T2 reduces from T to 0 and vice versa: here T is a prearranged maximum value of delay for both of the ganged variable delays T1 and T2. Operation of a delay control 174 varies both of the ganged variable delays T1 and T2 in combination, and changes their respective delays by amounts which are equal in magnitude and opposite in sign as per symbol 172, one being an increase and the other a reduction: in response to these variable delay changes, the angle of electrical tilt of the antenna array 166 also changes.

A third splitter S3 with voltage split ratios e1 and e2 splits tilt vector C into signals e1.C and e2.C, or equivalently c1.e1.V and c2.e1.V: signal e1.C is designated Cc (C central) and fed as a drive signal to the central antenna element Ec (an antenna element drive signal results in radiation of that signal from the antenna element into free space). Signal e2.C is further split by a fourth splitter S4 with voltage split ratios f1 and f2; this produces a signal c2.e2.f1.V designated Cu (C upper), and also a signal c2.e2.f2.V designated Cl (C lower). It is not essential that the signal Cc be not subject to delay in a variable or fixed delay device, but it is convenient to minimise circuitry and reduce design complexity and costs. Moreover, as described elsewhere herein, in practice the signal Cc is delayed or phase shifted by means not shown for phase padding purposes to compensate for delays introduced by components through which other signals pass.

The vectors A and Cu are used to provide drive signals to antenna elements E1U to E5L connected to the upper part of the corporate feed 164. Fifth and sixth splitters S5 and S6 with voltage split ratios a1, a2 and g1, g2 respectively split tilt vector A into signals a1.A and a2.A, and tilt vector Cu into signals g1.Cu and g2.Cu.

Similarly, the vectors B and Cl are used to provide drive signals to antenna elements E1L to E5L connected to the lower part of the corporate feed 164. Seventh and eighth splitters S7 and S8 with voltage split ratios b1, b2 and h1, h2 respectively split tilt vector B into signals b1.B and b2.B, and tilt vector Cl into signals h1.Cl and h2.Cl.

A ninth splitter S9 with voltage split ratios i1 and i2 splits signal a2.A from fifth splitter S5 into signals i1.a2.A and i2.a2.A, of which signal i1.a2.A is connected to and provides a drive signal for third upper antenna element E3U. A tenth splitter S10 with voltage split ratios j1 and j2 splits signal b2.B from seventh splitter S7 into signals j1.b2.B and j2.b2.B, of which signal j1.b2.B is connected to and provides a drive signal for third lower antenna element E3L.

The corporate feed 164 incorporates six vector combining devices HY1 to HY6, each of which is a 180 degree hybrid (sum and difference hybrid) having two input terminals designated 1 and 3 and two output terminals designated 2 and 4 as shown. Signals pass from each input to both outputs: a relative phase change of 180 degrees appears between signals passing between one input-output pair as compared to the other: as indicated by the location of a character π on each hybrid, this occurs between input 1 and output 4 in hybrids HY1 and HY2, and between input 3 and output 4 in hybrids HY3 to HY6. Each of the hybrids HY1 to HY6 produces two output signals which are the vector sum and difference of its input signals.

The first hybrid HY1 receives input signals a1.A from fifth splitter S5 and g2.Cu from sixth splitter S6: it adds and subtracts these signals to provide their difference as input to the third hybrid HY3 and their sum as input to the fifth hybrid HY5. Similarly, the second hybrid HY2 receives input signals b1.B from seventh splitter S7 and h2.Cl from eighth splitter S8: it provides these signals' difference as input to the fourth hybrid HY4 and their sum as input to the sixth hybrid HY6.

The third hybrid HY3 receives another input signal i2.a2.A from ninth splitter S9 in addition to that from first hybrid HY1, and produces sum and difference signals for output as drive signals to fourth and fifth upper antenna elements E4U and E5U respectively.

The fifth hybrid HY5 receives another input signal g1.Cu from sixth splitter S6 in addition to that from first hybrid HY1, and produces sum and difference signals for output as drive signals to first and second upper antenna elements E1U and E2U respectively.

The fourth hybrid HY4 receives another input signal j2.b2.B from seventh splitter S7 in addition to that from second hybrid HY2, and produces sum and difference signals for output as drive signals to fourth and fifth lower antenna elements E4L and E5L respectively.

The sixth hybrid HY6 receives another input signal h1.Cl from eighth splitter S8 in addition to that from second hybrid HY2, and produces sum and difference signals for output as drive signals to first and second lower antenna elements E1L and E2L respectively.

First, third and fifth hybrids HY1, HY3 and HY5 implement vector combination processes to generate signals for antenna elements E1U, E2U, E4U and E5U, and second, fourth and sixth hybrids HY2, HY4 and HY6 implement the like for antenna elements E1L, E2L, E4L and E5L. Signals for antenna elements Ec, E3U and E3L are generated by splitters without hybrids. Analysis of the signals reaching antenna elements E1U to E5U, Ec and E1L to E5L shows that their relative phasing is appropriate to collectively provide an antenna beam which is steerable in response to the tilt control 174 altering the ganged time delays T1 and T2 in mutually opposite senses, Phasing of signal vectors or drive signals for the antenna elements Ec, E1U to E5U and E1L to E5L relative to one another is imposed by the tilt controller 162 and the corporate feed 164 in combination. This relative phasing is prearranged by choice of splitting ratios and signals for vectorial combination in hybrids: it is appropriate for phased array beam steering by control of angle of electrical tilt, which varies in response to adjustment of the two variable delays T1 and T2.

Parameter Table: Splitter and Hybrid Parameters

| Splitter or Hybrid | Type | Parameter | Split Ratio or Scattering Parameter: Voltage Ratio | Decibels (dB) |
|---|---|---|---|---|
| S1 | DBQH | c1 | 0.7045 | −3.04 |
| | | c2 | 0.7097 | −2.98 |
| S2 | SDH | d1, d2 | 0.7071 | −3.01 |
| S3 | SDH | e1 | 0.6859 | −3.27 |
| | | e2 | 0.7277 | −2.76 |
| S4 | SDH | f1, f2 | 0.7071 | −3.01 |
| S5, S7 | DBQH | a1, b1 | 0.5559 | −5.10 |
| | | a2, b2 | 0.8313 | −1.61 |
| S6, S8 | DBQH | g1, h1 | 0.6636 | −3.56 |
| | | g2, h2 | 0.7481 | −2.52 |
| S9, S10 | DBQH | i1, j1 | 0.4421 | −7.09 |
| | | i2, j2 | 0.8970 | −0.94 |
| HY1, HY2 | SDH | s21, s43 | 0.7435 | −2.57 |
| | | s23, s41 | 0.6688 | −3.49 |
| HY3, HY4 | SDH | s21, s43 | 0.3162 | −10.00 |
| | | s23, s41 | 0.9487 | −0.46 |
| HY5, HY6 | SDH | s21, s43 | 0.3162 | −10.00 |
| | | s23, s41 | 0.9487 | −0.46 |

The splitters S1 to S9 and hybrids HY1 to HY6 provide voltage splitting ratios and input/output scattering parameters which are shown in the Parameter Table above, in which 'DBQH' means double box quadrature (90 degree) hybrid and 'SDH'=sum-and-difference (180 degree) hybrid; sxy (e.g. s21), where x is 2 or 4 and y is 1 or 3, represents a scattering parameter between ports x and y of each of the hybrids HY1 to HY6.

The splitter and vector combiner circuit 160 provides an increased antenna beam tilt range of 6.5 degrees compared to 4 degrees for a comparable system, 62.5% improvement, this being for a maximum side lobe level of −18 dB relative to boresight in each case. A tilt range of 10 degrees is obtainable if the antenna beam's upper side lobe 20 can be allowed to increase to −15 dB.

Figure 7:
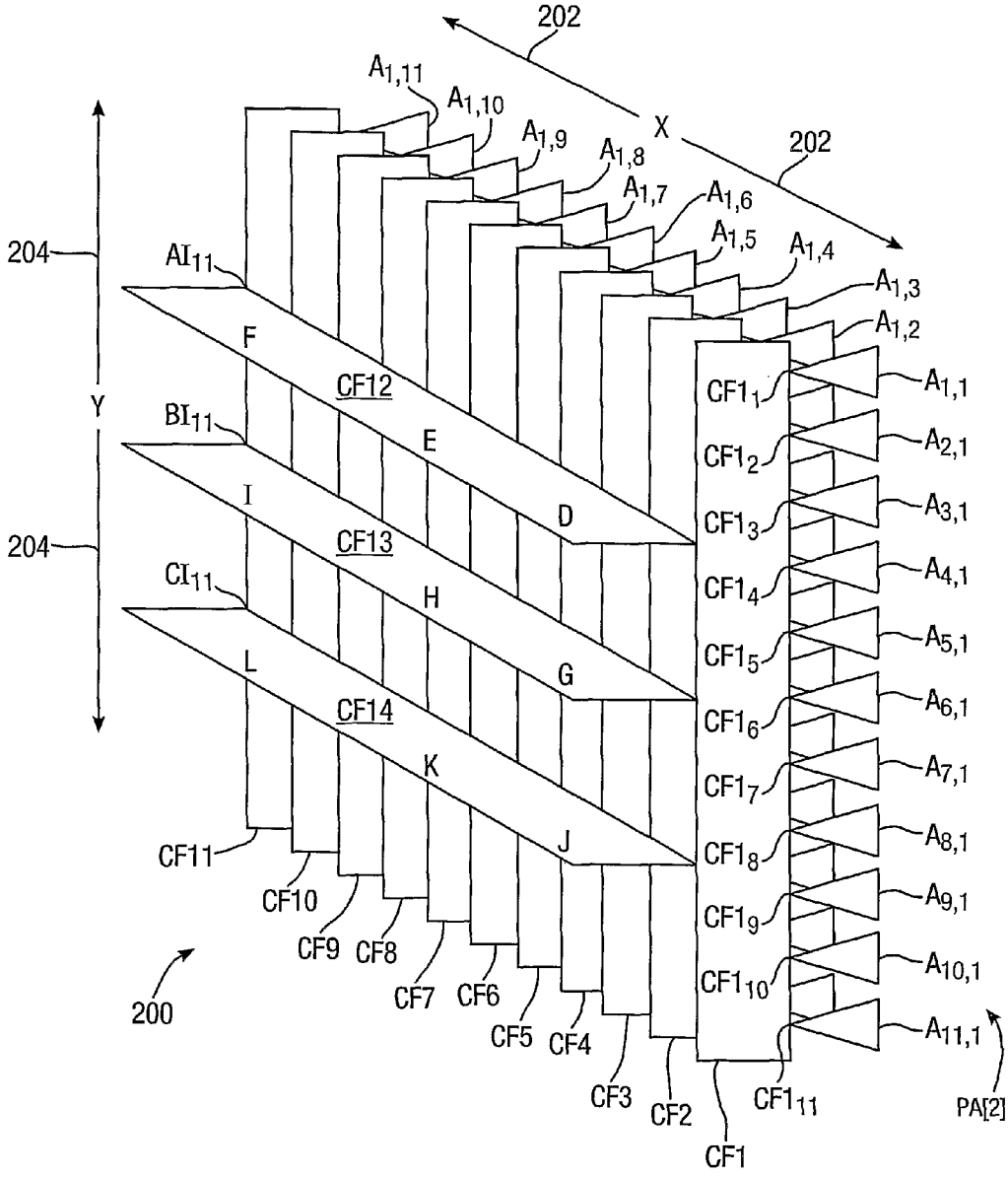
FIG. 7 is a functional drawing of a further embodiment of an antenna system of the invention which incorporates the FIG. 6 antenna corporate feed network.

Referring now to FIG. 7, there is shown a generalised block diagram representation of a further embodiment of the invention, i.e. a phased array antenna system 200 providing two dimensional scanning; the system 200 is equivalent to the system 30 described with reference to FIG. 2 with modification to implement the three input corporate feed (or splitter and vector combiner unit) 164 shown in FIG. 6. Description will concentrate on differences between FIGS. 2 and 7.

The antenna system 200 has an 11×11 two dimensional planar array PA[2] of one hundred and twenty-one antenna elements $A_{1,1}$ to $A_{11,1}$ (only partially shown) arranged in eleven columns or vertical lines (e.g. first column $A_{1,1}$ to $A_{11,1}$) with eleven antenna elements (e.g. $A_{1,1}$) per column. The array PA[2] has orthogonal X and Y scan directions indicated by arrows 202 and 204.

The eleven columns of the array PA[2] are connected to respective corporate feeds arranged as a first rank CF1 to CF11 of eleven such feeds: each of these feeds is equivalent to the three input corporate feed 164 and provides drive signal input to antenna elements in a respective column, e.g. corporate feed CF1 has eleven outputs $CF1_1$, to $CF1_{11}$ to provide input to antenna elements $A_{1,1}$ to $A_{11,1}$ respectively in the 1st column, with similar outputs (not shown) for other corporate feeds CF2 etc. and columns $A_{1,2}$ to $A_{11,2}$ etc.

The first rank splitter and vector combiner units CF1 to CF11 each have three inputs for signals equivalent to those shown as tilt vectors in FIG. 6, or as shown A, C and B in succession vertically downwards: To avoid illustrational complexity, these inputs are shown for the first and eleventh columns only as inputs AI1, CI1 and BI1 for column one and AI11, CI11 and BI11 for column eleven.

The antenna system 200 has three further corporate feeds arranged as a second rank of such feeds, i.e. twelfth, thirteenth and fourteenth corporate feeds CF12, CF13 and CF14 each equivalent to any one of first rank corporate feeds CF1 to CF11: twelfth corporate feed CF12 has three input terminals D, E and F for input signals equivalent to vectors A, C and B respectively in FIG. 6, and thirteenth and fourteenth corporate feeds CF13 and CF14 each have three input terminals G to I and J to L respectively for such signals.

The two ranks of splitter and vector combiner units CF1 to CF11 and CF12 to CF14 are connected in cascade as follows. The A inputs such as AI1 and AI11 of the first rank corporate feeds CF1 to CF11 (i.e. a line of upper inputs to these feeds) are connected to respective output terminals (not shown) of the twelfth corporate feed CF12. Similarly, the C inputs such as CI1 and CI11 of the first rank corporate feeds CF1 to CF11 (i.e. a line of central inputs) are connected to respective output terminals (not shown) of the thirteenth corporate feed CF13. Likewise, the B inputs such as BI1 and BI11 of the first rank corporate feeds CF1 to CF11 (i.e. a line of lower inputs) are connected to respective output terminals (not shown) of the fourteenth corporate feed CF14.

Control of scanning of the antenna array A[2] in two dimensions requires more complex signal phasing arrangements than the earlier embodiment 30. In this connection, referring now also to FIG. 8, a scan control apparatus 240 is shown which is for supplying signals to output terminals referenced D, E, F, G, H, I, J, K and L: these output terminals also represent the like-referenced input terminals of the twelfth, thirteenth and fourteenth corporate feeds CF12, CF13 and CF14 in the second rank.

The apparatus 240 consists of first, second, third and fourth tilt control units TC1 to TC4 of like construction and each having effect equivalent to the tilt controller 162 in FIG. 6. The first tilt control unit TC1 has an input TC1 in connected to a three way splitter SP1, which splits an RF input signal at TCin into three signal fractions for delay respectively at first and second variable time delays VT11 and VT12 and a fixed delay FT1. The variable time delays VT11 and VT12 are ganged as indicated by chain lines LX to provide delays in a like range 0 to T, but these delays vary in opposite senses as indicated by variability arrows VA11 and VA12 pointing in mutually orthogonal directions: i.e. first variable time delay VT11 goes from 0 to T as second variable time delay VT12 goes from T to 0. The ganged variable time delays VT11 and VT12 collectively provide an X direction scan control for the antenna system 200.

Second, third and fourth tilt control units TC2 to TC4 have equivalent components to those of first tilt control unit TC1, and are like referenced with the or a first index (as the case may be) changed from 1 to 2, 3 or 4 as appropriate.

The three signal fractions delayed in the first tilt control unit TC1 at first and second variable time delays VT11 and VT12 and a fixed delay FT1 pass as respective input signals to the second, third and fourth tilt control units TC2 to TC4. Each of the second, third and fourth tilt control units TC2 to TC4 splits its respective input signal into three signal fractions and delays these fractions in respective delays VTk1, VTk2 and FTk (k=2, 3 or 4), two of which are variable in opposite senses to one another and the third fixed (as in the first tilt control unit TC1).

Signal fractions delayed in the second tilt control unit TC2 pass respectively to output terminals D, E and F; those delayed in the third tilt control unit TC3 pass respectively to output terminals G, H and I, and those delayed in the fourth tilt control unit TC4 pass respectively to output terminals J, K and L. The variable delays VT21, VT22, VT31, VT32, VT41 and VT42 of the second, third and fourth tilt control units TC2 to TC4 are ganged as indicated by chain lines LY and provide a Y direction scan control for the antenna system 200.

Delays in signal paths between input TC1 in to the first tilt control unit TC1 and output terminals D to L are shown in the Delay Table below, in which Fk indicates delay at fixed delay FTq, +Tq indicates delay at variable delay VTq1 (q=1, 2, 3 or 4) with leftward inclined arrow, and −Tq indicates delay at variable delay VTq2 with rightward inclined arrow indicating opposite sense delay variation.

As has been said, output terminals D to L are also input terminals to the twelfth, thirteenth and fourteenth corporate feeds CF12, CF13 and CF14 in the second rank, which therefore receive respective groups of three input signals delayed in accordance with the Delay Table above. By a similar analysis to that given above in connection with the embodiment described with reference to FIGS. 2 to 5, it can be shown that operation of the X and Y direction scan controls LX and LY provides scanning of the antenna beam direction of the antenna system 200 in both X and Y (i.e. orthogonal) dimensions.

Delay Table

| Output Terminal | Signal Path Delay |
|---|---|
| D | +T1, +T2 |
| E | +T1, F2 |
| F | +T1, −T2 |
| G | F1, +T3 |
| H | F1, F3 |
| I | F1, −T3 |
| J | −T1, +T4 |
| K | −T1, F4 |
| L | −T1, −T4 |

Figure 8:
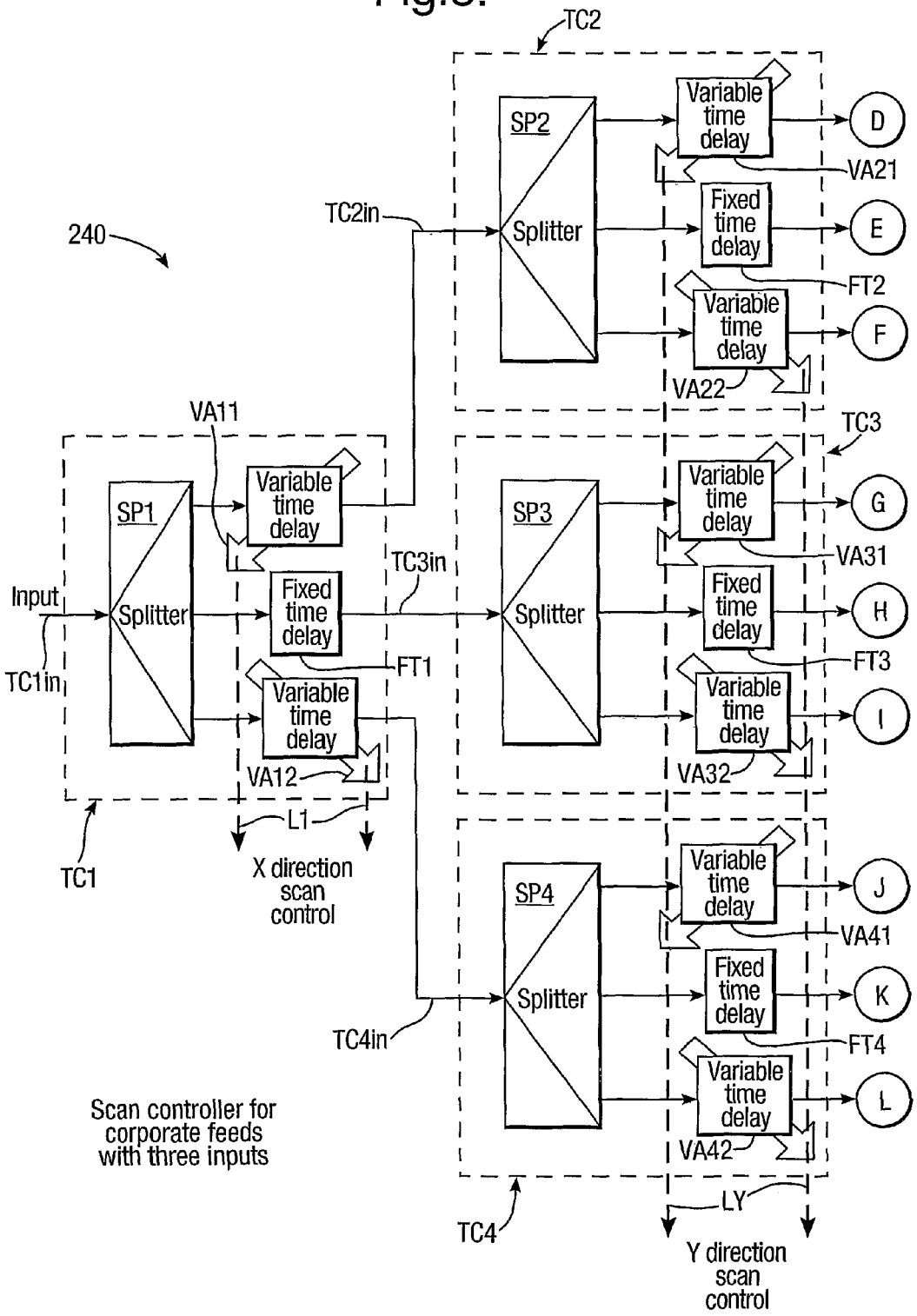
FIG. 8 illustrates signal phase control circuitry for the FIG. 2 antenna system.

The embodiment of the invention described with reference to FIGS. 6 to 8 uses a "few to many" signal converter or corporate feed network where "few" is three and many is "eleven". It is also possible to use a "few to many" signal converter or corporate feed network where "few" is more than three by adding further variably delayed signals: i.e. splitters SP1 etc. in FIG. 8 would be modified to split into more signals and the or (as the case may be) each additional signal would be variably delayed.

Antenna elements (e.g. $A_{1,1}$ to $A_{11,11}$ in FIG. 7) may be disposed in a square or rectangular grid as illustrated, but other element arrangements are also possible: for example, antenna elements may be in a hexagonal array i.e. at the vertices of a hexagonal grid: a hexagonal array provides minimum inter element coupling for a given number of elements and a given area of antenna array. A hexagonal array leads to alternate columns of antenna elements being staggered in position relative to respective adjacent columns by half of the spacing between adjacent elements.

The element array need not be fully populated: i.e. the array might be a sparse array in which elements are located at periodic positions defining a geometrical array but some array positions do not have antenna elements located there—the array has holes. This reduces the required number of elements making the antenna system cheaper: it also changes the beam shape, which is useful to provide different beam widths in azimuth and elevation The perimeter of the antenna element array need not be the same shape as that indicated by element locations: e.g. if seeking equal beamwidths in azimuth and elevation, antenna elements may be used which are located on a hexagonal grid and also lying within or delimited by a circle. Alternatively, for different azimuth and elevation beamwidths, the hexagonal grid of antenna elements may lie within an ellipse. A further alternative is the hexagonal grid of antenna elements lying within a stretched hexagon.

The embodiments of the invention described above use like first rank and second rank corporate feeds. It is not essential for the first rank corporate feeds to be alike: they may have different numbers of outputs and be connected to differing numbers of antenna elements. They may also have different amplitude and phase weightings, in order to adjust for different element patterns resulting from differing numbers of antenna elements. In addition, the first rank corporate feeds may have differing numbers of inputs from second rank corporate feeds. If the first rank corporate feeds are not all alike, then the second rank corporate feeds may be different in consequence.

The invention is suitable for use in all areas of technology employing scanning phased array antennas, e.g. radar, television and radio broadcasting and telecommunications including cellular radio ("mobile telephones"). It can be used at any frequency for which appropriate components (antenna elements, corporate feed networks, phase shifters etc.) are available, and including radio, microwave, millimetric wave, near and far infrared and optical frequencies.

The invention claimed is:

1. A phased array antenna system having a two dimensional array of antenna elements and a plurality of corporate feed networks, and wherein:

a) the corporate feed networks are grouped in first and second ranks and are arranged to convert network input signals of variable phase relative to one another into network output signals phased appropriately for antenna elements of a phased array, the network output signals being in relatively greater numbers than the network input signals for corporate feed networks in at least one of the first and second ranks;

b) first rank corporate feed networks are arranged to provide network output signals as input signals to respective lines of antenna elements; and c) second rank corporate feed networks are arranged to provide network output signals as input signals to respective lines of inputs of each first rank corporate feed network; and d) the system includes phase difference control means for varying network input signal phasing for second rank corporate feed networks each comprising two inputs whereby to provide control of antenna beam direction in two dimensions wherein the phase difference control means further comprises:

i) a first variable phase shifter connected via a splitter to a second variable phase shifter and a first fixed phase shifter each connected to respective inputs of one second rank corporate feed network;

ii) a second fixed phase shifter connected via a splitter to a third variable phase shifter and a third fixed phase shifter each connected to respective inputs of another second rank corporate feed network; and iii) means for ganging together operation of the second and third variable phase shifters.

2. A phased array antenna system according to claim 1 wherein the phase difference control means is arranged to:

a) vary the phase difference between each input signal to one second rank corporate feed network and input signals to another second rank corporate feed network to provide control of antenna beam direction in a first dimension; and b) vary both the phase difference between input signals to one second rank corporate feed network and the phase difference between input signals to another second rank corporate feed network to provide control of antenna beam direction in a second dimension.

3. A phased array antenna system according to claim 2 wherein the phase difference control means is arranged to maintain:

a) the phase difference between input signals to one second rank corporate feed network to be equal to the phase difference between input signals to another second rank corporate feed network; and b) the phase differences between each input signal to one second rank corporate feed network and input signals to another second rank corporate feed network to be equal.

4. A phased array antenna system including a two dimensional array of antenna elements arranged in lines, and wherein:

a) each line of antenna elements is associated with a respective first rank corporate feed network having outputs for providing signals to respective antenna elements and inputs for receiving signals of variable phase relative to one another;

b) each first rank corporate feed network has:

i) first inputs connected to outputs of one second rank corporate feed network;

ii) second inputs connected to outputs of another second rank corporate feed network;

c) the corporate feed networks provide a means for converting input signals of variable phase relative to one another into multiple output signals for phased array antenna elements, the number of output signals being relatively greater than the number of input signals; and d) the system includes phase difference varying means for:

i) varying the phase difference between each input signal to one second rank corporate feed network and input signals to another second rank corporate feed network to provide control of antenna beam direction in a first dimension; and ii) varying both the phase difference between input signals at a plurality of inputs to one second rank corporate feed network and the phase difference between input signals at a plurality of inputs to another second rank corporate feed network to provide control of antenna beam direction in a second dimension wherein the phase difference varying means comprises:

a first variable phase shifter connected via a splitter to a second variable phase shifter and a first fixed phase shifter each connected to respective inputs of one second rank corporate feed network;

a second fixed phase shifter connected via a splitter to a third variable phase shifter and a third fixed phase shifter each connected to respective inputs of another second rank corporate feed network; and means for ganging together operation of the second and third variable phase shifters.

5. A phased array antenna system according to claim 4 wherein each corporate feed network provides a means for converting input signals expressed by vectors A and B into other signal vectors given by expressions of the form $p_t A + q_t B$, where $p_t$ and $q_t$ are numerical factors in the range −1 to 1.

6. A phased array antenna system according to claim 4, wherein antenna elements are positioned to define a curved surface such as a cylindrical, spherical or toroidal surface.

7. A method of scanning a phased array antenna system having a two dimensional array of antenna elements and a plurality of corporate feed networks wherein the corporate feed networks are grouped in first and second ranks and are arranged to convert network input signals of variable phase relative to one another into network output signals phased appropriately for antenna elements of a phased array, the network output signals being in relatively greater numbers than the network input signals for corporate feed networks in at least one of the first and second ranks, first rank corporate feed networks are arranged to provide network output signals as input signals to respective lines of antenna elements, and second rank corporate feed networks are each arranged to provide network output signals as input signals to respective lines of inputs of each first rank corporate feed network the method comprising varying network input signal phasing for second rank corporate feed networks each comprising two inputs to provide control of antenna beam direction in two dimensions by the steps of:

i) applying a first variable phase shift via a splitter to a second variable phase shifter and a first fixed phase shifter each connected to respective inputs of one second rank corporate feed network;

ii) applying a second fixed phase shift via a splitter to a third variable phase shifter and a third fixed phase shifter each connected to respective inputs of another second rank corporate feed network; and iii) ganging together operation of the second and third variable phase shifters.

8. A method according to claim 7 wherein the step of varying network input signal phasing comprises:

a) varying the phase difference between each input signal to one second rank corporate feed network and input signals to another second rank corporate feed network to provide control of antenna beam direction in a first dimension; and b) varying both the phase difference between input signals to one second rank corporate feed network and the phase difference between input signals to another second rank corporate feed network to provide control of antenna beam direction in a second dimension.

9. A method according to claim 8 including maintaining equal:

a) the phase difference between input signals to one second rank corporate feed network and the phase difference between input signals to another second rank corporate feed network; and b) the phase differences between each input signal to one second rank corporate feed network and input signals to another second rank corporate feed network.

10. A method of scanning a phased array antenna system having a two dimensional array of antenna elements arranged in lines, and wherein a) each line of antenna elements is associated with a respective first rank corporate feed network having outputs for providing signals to respective antenna elements and inputs for receiving signals of variable phase relative to one another each first rank corporate feed network has first inputs connected to outputs of one second rank corporate feed network; second inputs connected to outputs of another second rank corporate feed network and wherein the corporate feed networks provide a means for converting input signals of variable phase relative to one another into multiple output signals for phased array antenna elements the output signals being in relatively greater in number compared to the input signals; the method comprising the steps of a) varying the phase difference between each input signal to one second rank corporate feed network and input signals to another second rank corporate feed network to provide control of antenna beam direction in a first dimension; and b) varying both the phase difference between input signals at a plurality of inputs to one second rank corporate feed network and the phase difference between input signals at a plurality of inputs to another second rank corporate feed network to provide control of antenna beam direction in a second dimension wherein the steps of varying phase difference comprises the further steps of:

i) applying a first variable phase shift via a splitter to a second variable phase shifter and a first fixed phase shifter each connected to respective inputs of one second rank corporate feed network;

ii) applying a second fixed phase shift via a splitter to a third variable phase shifter and a third fixed phase shifter each connected to respective inputs of another second rank corporate feed network; and iii) ganging together operation of the second and third variable phase shifters.

11. A method according to claim 10 wherein each corporate feed network provides a means for converting input signals expressed by vectors A and B into other signal vectors given by expressions of the form $p_i A+q_i B$, where $p_i$ and $q_i$ are numerical factors in the range −1 to 1.

12. A method according to claim 10 including positioning the antenna elements to define a curved surface such as a cylindrical, spherical or toroidal surface.

13. A phased array antenna system according to claim 5 wherein antenna elements are positioned to define a curved surface such as a cylindrical, spherical or toroidal surface.

14. A phased array antenna system according to claim wherein antenna elements are positioned to define a curved surface such as a cylindrical, spherical or toroidal surface.

15. A method according to claim 11 including positioning the antenna elements to define a curved surface such as a cylindrical, spherical or toroidal surface.

16. A method according to claim 7 including positioning the antenna elements to define a curved surface such as a cylindrical, spherical or toroidal surface.

* * * * *